US005810352A

United States Patent [19]

Kobayashi et al.

[11] Patent Number: 5,810,352

[45] **Date of Patent: *Sep. 22, 1998**

[54] SORTER

[75] Inventors: Misao Kobayashi; Makoto Shimura, both of Yamanasi-ken, Japan

[73] Assignee: Nisca Corporation, Yamanashi-Ken, Japan

[ * ] Notice: The term of this patent shall not extend beyond the expiration date of Pat. No. 5,685,540.

[21] Appl. No.: 858,402

[22] Filed: May 19, 1997

Related U.S. Application Data

[62] Division of Ser. No. 460,222, Jun. 1, 1995, Pat. No. 5,685, 540.

[30] Foreign Application Priority Data

Jun. 3, 1994 [JP] Japan ..... HEI06-145600

[51] Int. Cl.[6] ..... B65H 39/10

[52] U.S. Cl. ..... 271/293; 271/294; 271/288

[58] Field of Search ..... 271/288, 293, 271/294

[56] References Cited

U.S. PATENT DOCUMENTS

| | | | |
|---|---|---|---|
| 4,214,746 | 7/1980 | Redding et al. | 271/294 |
| 5,236,189 | 8/1993 | Ikoma | 271/293 |
| 5,524,873 | 6/1996 | Hosoi et al. | 271/294 |
| 5,580,038 | 12/1996 | Furuya et al. | 270/58.11 |
| 5,657,977 | 8/1997 | Kato et al. | 270/52.14 |
| 5,673,906 | 10/1997 | Furuya et al. | 270/58.14 |
| 5,685,540 | 11/1997 | Kobayashi et al. | 271/293 |

*Primary Examiner*—H. Grant Skaggs

*Attorney, Agent, or Firm*—Kane, Dalsimer, Sullivan, Kurucz, Levy, Eisele and Richard, LLP

[57] ABSTRACT

A sorter has a plurality of sorting tray to receive copied sheets. The sorting trays are moved vertically upon rotation of screw rods. The screw rod has a spiral cam groove with a predetermined cam profile formed on the outer periphery thereof. Cam followers of the sorting tray is engaged with the spiral cam groove. The cam groove is formed such that a distance between adjacent sorting trays in the vertical direction the screw rod is stopped at a first rotational position is different from that when the screw rod is stopped at a second rotational position.

6 Claims, 16 Drawing Sheets

SORTER

This is a division of application Ser. No. 08/460,222 filed Jun. 1, 1995 now U.S. Pat. No. 5,685,540.

BACKGROUND OF THE INVENTION AND RELATED ART STATEMENT

The present invention relates to a sorter for sorting sheets which are transferred from a sheet processor, more specifically, it relates to a sorter which includes a plurality of sorting trays to each of which the sheets are distributed and received thereon and each of which is movable in the vertical direction.

In a conventional sheet processor, such as an electrostatic copying machine, where plural pages of documents are collectively set on a document rest of an automatic document feeder which is disposed on a platen glass, the documents are successively fed onto the platen glass upon depression of a copy start button. The image of each document which is fed onto the platen glass is copied onto a sheet using an electrostatic copying process and the copied sheet is discharged from a discharge port to outside.

A sorter is detachably connected to the copying machine for receiving the copied sheets discharged from the discharge port and for collecting them to a predetermined sorting tray among a plurality of sorting trays when a non-sort mode is selected and for sorting or grouping them to the plurality of sorting trays when a sorting or grouping mode is selected.

Recently, the copying machine becomes to be reduced in size and accordingly the sorter is necessary to be reduced in size. To comply with this demand, the conventional sorter is constructed in such a manner that an inlet port is formed to face to the discharge port of the copying machine in order to communicate therewith, each of the sorting trays is movable in the vertical direction to meet with a distribute port which is communicated with the inlet port and through which the copied sheet is distributed onto the sorting tray located in a receiving position and screw rods are provided so as to stand upright and all of the sorting trays are engaged with the spiral groove which is formed to the outer peripheral surface of each of the screw rods.

Since the conventional sorter is constructed as described above, each of the sorting trays is moved upward or downward upon the rotation of the screw rods clockwise or counterclockwise. More specifically, each of the sorting trays ascends or descends by a predetermined pitch or lead which corresponds to the lead angle of the spiral groove. To change the amount of the pitch in the conventional sorter, the spiral groove has a variety of lead angles.

As a result, the pitch of the spiral groove is changed in accordance with the lead angle of the spiral groove when the screw rod is rotated by 360 degrees, that is, one rotation. In other words, the distances between the adjacent sorting trays are different from each other corresponding to the lead angles of the spiral grooves to which the adjacent sorting trays are engaged, respectively.

In the conventional sorter, however, the sorting tray which opposes to the distribute port and is capable of receiving the copied sheets from the copying machine through the discharge port (that is, which is located in a so-called "receiving position") always has the widest space between the just above sorting tray and itself, nevertheless the sorter executes a sheet receiving operation or a sheet take-out operation.

That is to say, the distance between the sorting tray in the receiving position and a sorting tray just above the sorting tray in the receiving position is always set to be widest among those of the adjacent sorting trays other than the sorting tray in the receiving position. This distance of the sorting trays, one of which is in the receiving position, is kept to the same value even when the other sorting tray is moved to the receiving position.

It should be noted that it is not necessary to keep wide the distance of the sorting tray in the receiving position when the take-out condition is selected but it is preferable to keep wide it when the receiving condition is selected. Accordingly, in the conventional sorter, it is superfluous to keep wide the distance of the sorting tray in the receiving position.

SUMMARY OF THE INVENTION

The present invention, therefore, has as its principal object to provide a sorter which is convenient to use by altering positions of the sorting trays, corresponding to at least receiving and take-out conditions.

Further it is another object of the present invention to provide a sorter which is convenient to use by altering a distance between the sorting tray in the receiving position and a sorting tray just above the sorting tray in the receiving position rather than that between adjacent sorting trays other than the sorting tray in the receiving position, corresponding to at least receiving and take-out conditions.

In order to attain the above-mentioned object, there is provided a sorter according to a first aspect of the present invention which comprises: a plurality of sorting trays, to which at least one sheet is transferred from a sheet processor, which are movable and arranged in a vertical direction, and each of which includes at least one cam follower; and drive means for moving the sorting trays in the vertical direction, including a drive source and at least one screw rod which extends in the vertical direction and is rotated about the vertical central axis thereof by said driving source, said screw rod having a spiral cam groove with a predetermined cam profile formed on the outer periphery thereof and said cam follower of each sorting tray being engaged with said spiral cam groove, wherein at least first and second rotational positions of said screw rod are defined in every one rotation thereof, and said spiral cam groove is formed such that a distance between adjacent sorting trays in the vertical direction when said screw rod is stopped at said first rotational position is different from that when said screw rod is stopped at said second rotational position.

According to a second aspect of the present invention, there is provided a sorter which comprises: a plurality of sorting trays, to which at least one sheet is supplied from a sheet processor, and which are movable and arranged in a vertical direction; and change means for changing a distance between adjacent sorting trays in the vertical direction between at a sheet receiving mode where the sheets are supplied from the sheet processor and received on said sorting trays and at a sheet takeout mode where the sheets received on said sorting trays are taken out.

According to a third aspect of the present invention, there is provided a sorter which comprises: a plurality of sorting trays, to which at least one sheet is supplied from a sheet processor, which are movable and arranged in a vertical direction, and each of which includes at least one cam follower; at least one screw rod which extends in the vertical direction and is rotatable about the vertical central axis thereof, said screw rod having a spiral cam groove with a predetermined cam profile formed on the outer periphery thereof and said cam follower of each sorting tray being engaged with said spiral cam groove; each of said sorting trays being moved in the vertical direction upon rotation of said screw rod through the engagement of said cam follower with said spiral cam groove; and control means for controlling said rotation of the screw rod in such a manner that first and second rotational positions corresponding to sheet receiving mode and sheet take-out mode, respectively are defined in every one rotation of said screw rod, said first and second rotational positions being set to be different from each other in the circumferential direction of the screw rod.

BRIEF DESCRIPTION OF DRAWINGS

These and other objects of the subject invention will become more fully apparent as the following description is read in light of the attached drawings wherein.

DETAILED DESCRIPTION OF THE PREFERRED EMBODIMENT

Hereinafter, the detailed description of the preferred embodiment of a sorter according to the present invention will be given with reference to the accompanying drawings.

[Description of the entire construction of sorter 10]

Figure 1:
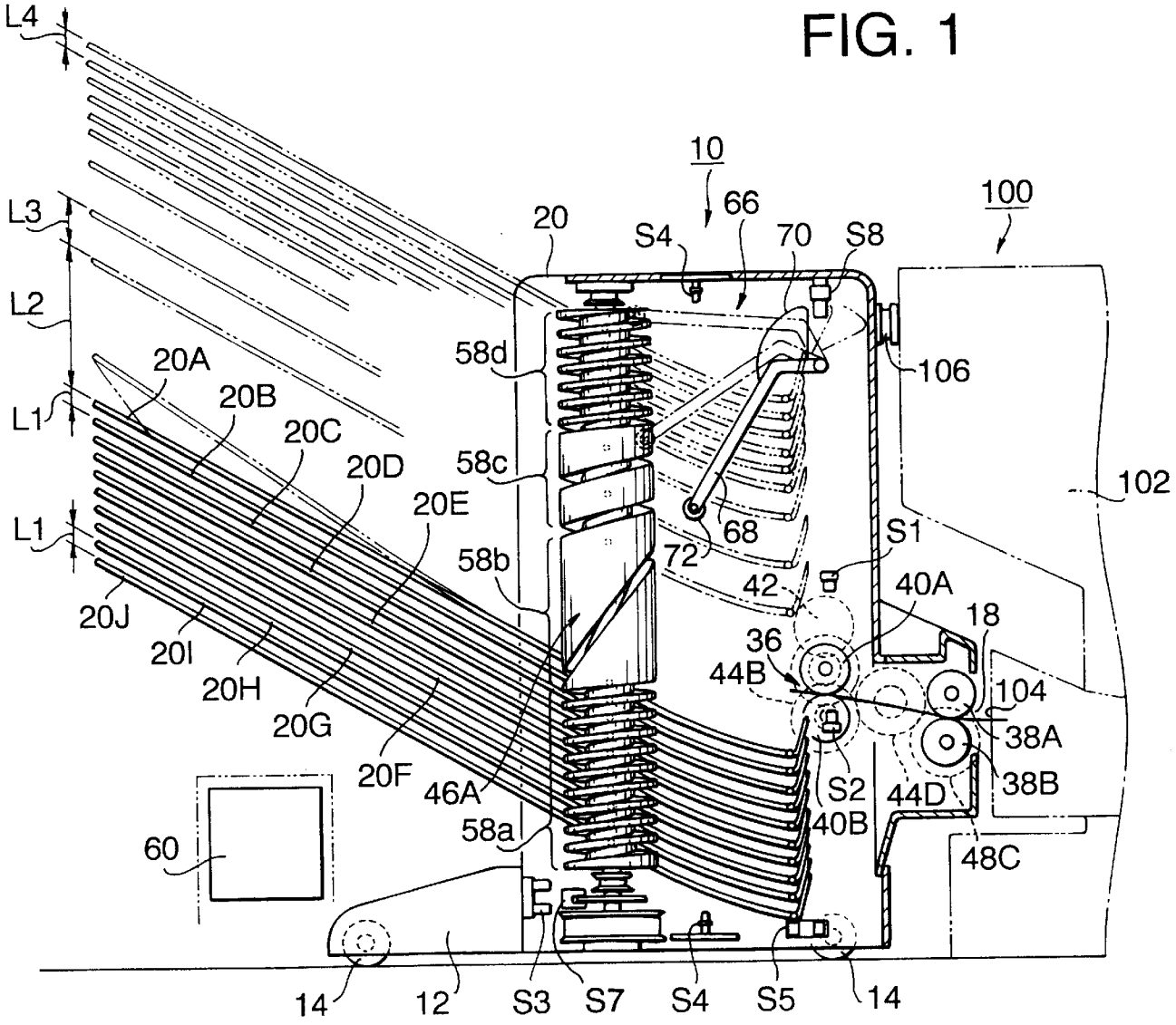
FIG. 1 is a front view showing a schematic construction of a sorter of the preferred embodiment according to the present invention.

As shown in FIG. 1, the sorter 10 of the present embodiment is detachably attached to an electrostatic copying machine 100 as a sheet processor. The sorter is to be connected mechanically and electrically to the copying machine 100 and constructed so as to execute a so-called "sorting treatment" and so-called "grouping treatment" selectively, to a plurality of copied sheets transferred from the copying machine 100.

In the present embodiment, the sorting treatment means that, in the case where plural pages of originals are copied to sheets by a plural sets in the copying machine 100, each set of copied sheets on a sorting tray includes all of the pages copied. On the other hand, the grouping treatment means that, in the case where plural pages of the originals are copied to sheets by plural sets in the copying machine 100, each set on a sorting tray includes a plurality of copied sheets of the same page.

The copying machine 100 includes a housing 102 in which an electrostatic copying process mechanism is contained and a discharge port 104 which is formed to the side surface of the housing 102 and through which sheet on which an image of a document is copied is discharged. The mechanism of the copying machine 100 is well known, therefore, the detailed description of the copying machine 100 will be omitted.

[Description of skeleton of sorter 10 ]

The sorter 10 is provided with a base 12 which is movable on a floor through casters 14 attached to the undersurface of the base 12, and a frame 16 fixed onto the base 12. An inlet port 18 is formed to the side surface of the frame 16 which opposes to the copying machine 100. Where the sorter 10 is attached to the copying machine 100 in the predetermined position, the sorter 10 is fixed thereto through a magnet catch 106 and the inlet port 18 is set to be communicated with the discharge port 104. Accordingly the copied sheets discharged from the copying machine 100 through the discharge port 104 are introduced inside the frame 16 of the sorter 10 through the inlet port 18.

The sorter 10 is further provided with a plurality of sorting trays 20, more specifically, ten sorting trays 20A through 20J in the present embodiment. The proximal end of each sorting tray 20 is received inside the frame 16 and distal end thereof is protruded from the frame 16 to outside (to left in FIG. 1). All sorting trays 20 are set to be movable in the vertical direction and moved by a tray drive mechanism 22 which will be described in detail.

Figure 2:
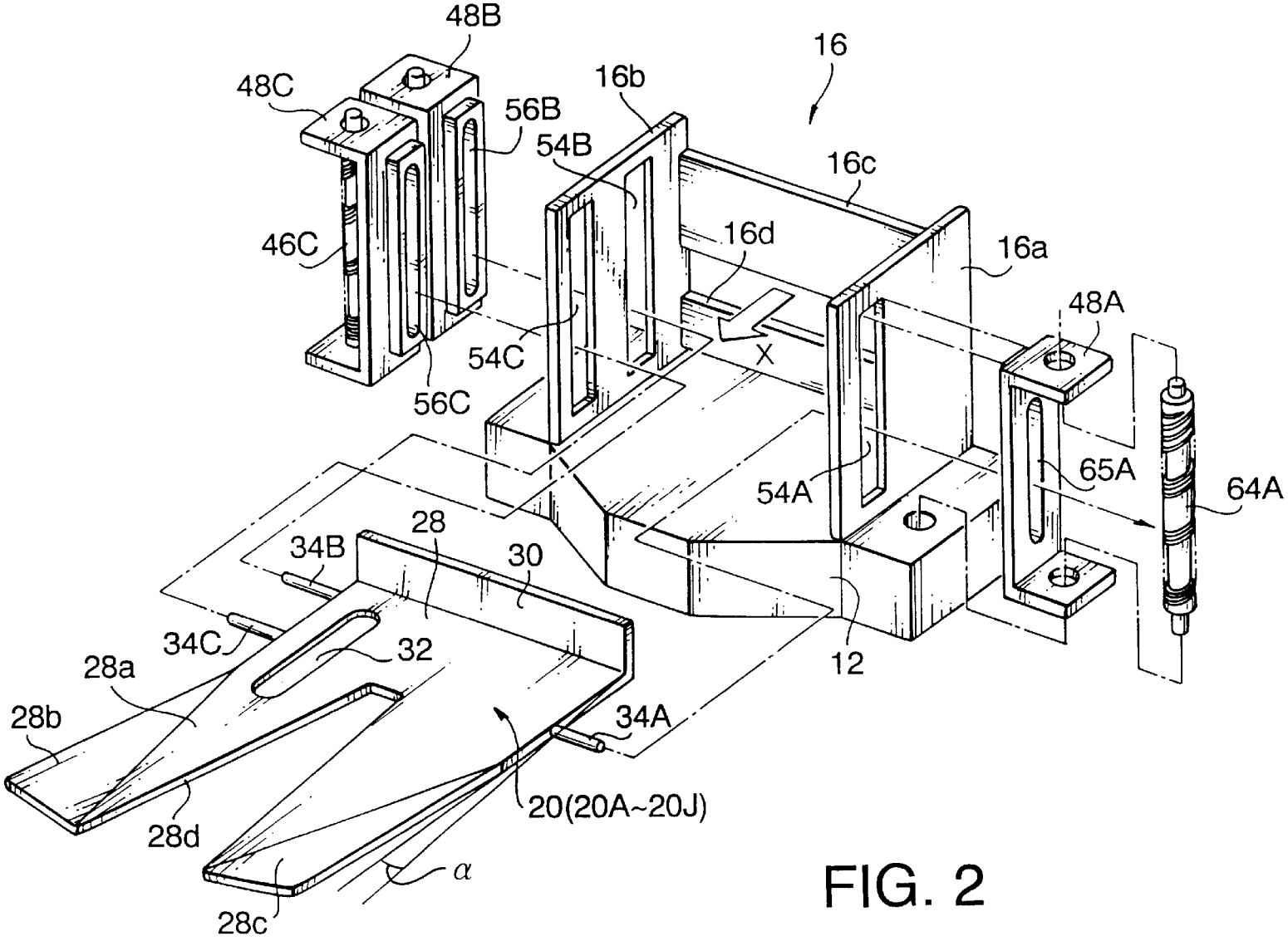
FIG. 2 is a perspective view showing a sorting tray and a sorting tray drive mechanism.

As shown in FIG. 2, the frame 16 includes a pair of side plates 16*a* and 16*b* between which the proximal end of each sorting tray 20 is clamped, an upper coupling plate 16*c* stably coupling the upper portions of the side plates 16*a* and 16*b* with each other and a lower coupling plate 16*d* stably coupling the lower portions of the side plates 16*a* and 16*b* with each other. The distance (or space) between the upper and lower plates 16*c* and 16*d* is defined as a distribute port 24 through which copied sheets are distributed to a sorting tray 20 in a receiving position.

Note that the sorting tray 20 in the receiving position is defined by a sorting tray 20 which is located in a position where it meets with the distribute port 24 and can receive the copied sheets put out from the distribute port 24.

As shown in FIG. 1, a cover member 26 is swingably attached over the upper portions of the side plates 16*a* and 16*b*, for covering an upper part of the frame 16 in a closed position. When the cover member 26 is swung to an open position from the closed position, the upper part of the frame 16 is opened, thereby enabling to easily access the uppermost first sorting tray 20A.

[Description of sorting tray 20]

As shown in FIG. 2, each of the sorting trays 20 extends in a sheet receiving direction X in which the copied sheets are fed through the distribute port 24 and received onto the sorting tray 20 in the receiving position. All of the sorting trays 20 (20A to 20J) are set to be parallel to each other, as shown in FIG. 1.

Figure 4:
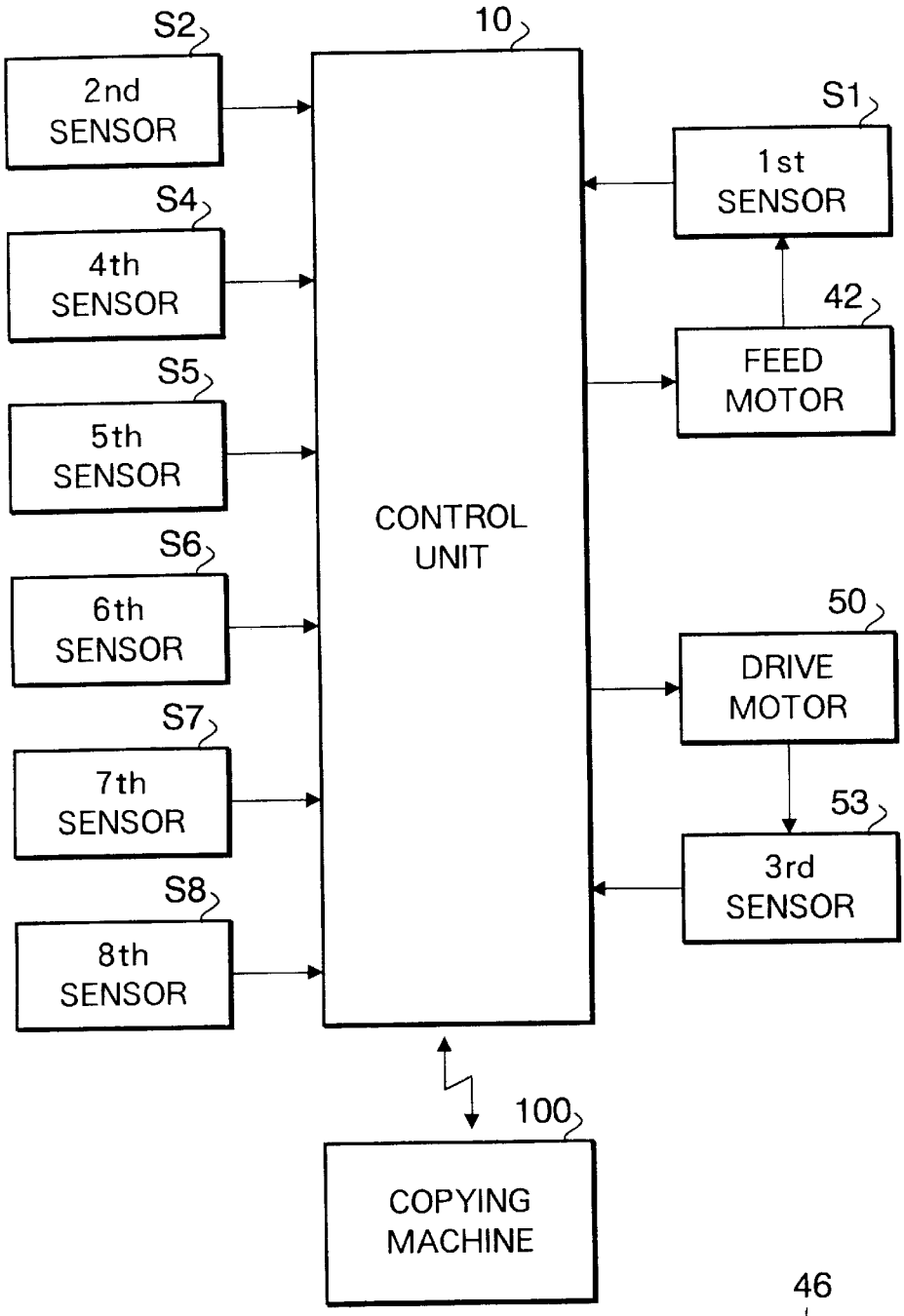
FIG. 4 is a block diagram showing a construction of a control system of the sorter.

As shown in FIGS. 2 and 4, each sorting tray 20 is provided with a receiving plate 28 which is inclined to the horizontal plane by a predetermined angle $\alpha$ so that the distal end of the sorting tray 20 is higher than the proximal end thereof and on which the copied sheets are received, and a stop plate 30 which stands at a proximal end of the receiving plate 28 and against which the copied sheet received on the receiving plate 28 is slid to abut.

That is, the copied sheet which is fed through the distribute port 24 is received on the receiving plate 28 at a substantially mid point thereof, and then it is slid in a direction opposite to the sheet receiving direction X due to the inclination of the receiving plate 28. As a result, a proximal end of the sheet on the upstream side with respect to the sheet receiving direction X is come to abut against the stop plate 30, accordingly all of the copied sheets disposed on the sorting tray 20 are aligned to each other at the proximal end thereof.

The receiving plate 28 of the sorting tray 20 includes a flat main portion 28*a*, and a pair of slant portions 28*b* and 28*c* which are slant to the main portion 28*a* and positioned on the downstream side with respect to the sheet receiving direction X and both lateral sides of the main portion 28*a*. A recessed portion 28*d* is formed to the center of the distal end of the main portion 28*a*, for facilitating the grip of the copied sheets received on the sorting tray 20 by an operator.

An elongated through hole 32 is formed to the main portion 28*a* of the receiving plate 28 of each sorting tray 20. The hole 32 is provided so that a detecting lever of the sheet detecting mechanism (which will be described later in detail) is dropped into.

First to third pins 34A, 34B and 34C as cam followers are attached to the lateral sides of the receiving plate 28. More specifically, the first pin 34A is attached to one lateral side of the receiving plate 28 and the second and third pins 34B and 34C are attached to the other lateral side of the receiving plate 28. The first to third pins 34A, 34B and 34C are provided so that they engage with spiral grooves of first to third screw rods 46A, 46B and 46C (which will be described later in detail), respectively.

[Description of sheet feed mechanism 36]

As shown in FIG. 1, a sheet feed mechanism 36 is provided for feeding the copied sheet P, which is discharged from the discharge port 104 of the copying machine 100 and introduced into the inlet port 18, to the distribute port 24 and putting out it onto the sorting tray 20 in the receiving position. The sheet feed mechanism 36 is provided between the inlet port 18 and the distribute port 24 and provided with a pair of upper and lower inlet rollers 38A and 38B and a pair of upper and lower outlet rollers 40A and 40B.

The upper inlet roller 38A is pressingly contacting the lower inlet roller 38B and the nip between the upper and lower inlet rollers 38A and 38B is aligned with the inlet port 18. The upper outlet roller 40A is pressingly contacting the lower outlet roller 40B and the nip between the upper and lower outlet roller 40A and 40B is aligned with the distribute port 24.

The sheet feed mechanism 36 further includes a feed motor 42, a first driven gear 44A which is connected rotatably and coaxially to the upper outlet roller 40A and driven to rotate by the feed motor 42, a second driven gear 44B which is coaxially fixed to the lower outlet roller 40B and meshed with the first driven gear 44A, a third driven gear 44C which is fixed coaxially to the lower inlet roller 38B and an idle gear 48*d* which is meshed with the second and third driven gear 44B.

Since the sheet feed mechanism 36 is constructed as described above, the lower inlet roller 38B and the lower outlet roller 40B are driven to rotate counterclockwise upon the drive of the feed motor 42. Accordingly, the copied sheet introduced into the inlet port 18 is clamped between the upper and lower inlet rollers 38A and 38B, fed to the nip portion of the upper and lower outlet rollers 40A and 40B upon the counterclockwise rotation of the lower inlet roller 38B, clamped between the upper and lower outlet rollers 40A and 40B, and then put out from the distribute port 24 onto the sorting tray 20 in the receiving position upon the counterclockwise rotation of the lower outlet roller 40B.

[Description of tray drive mechanism 22]

Figure 3:
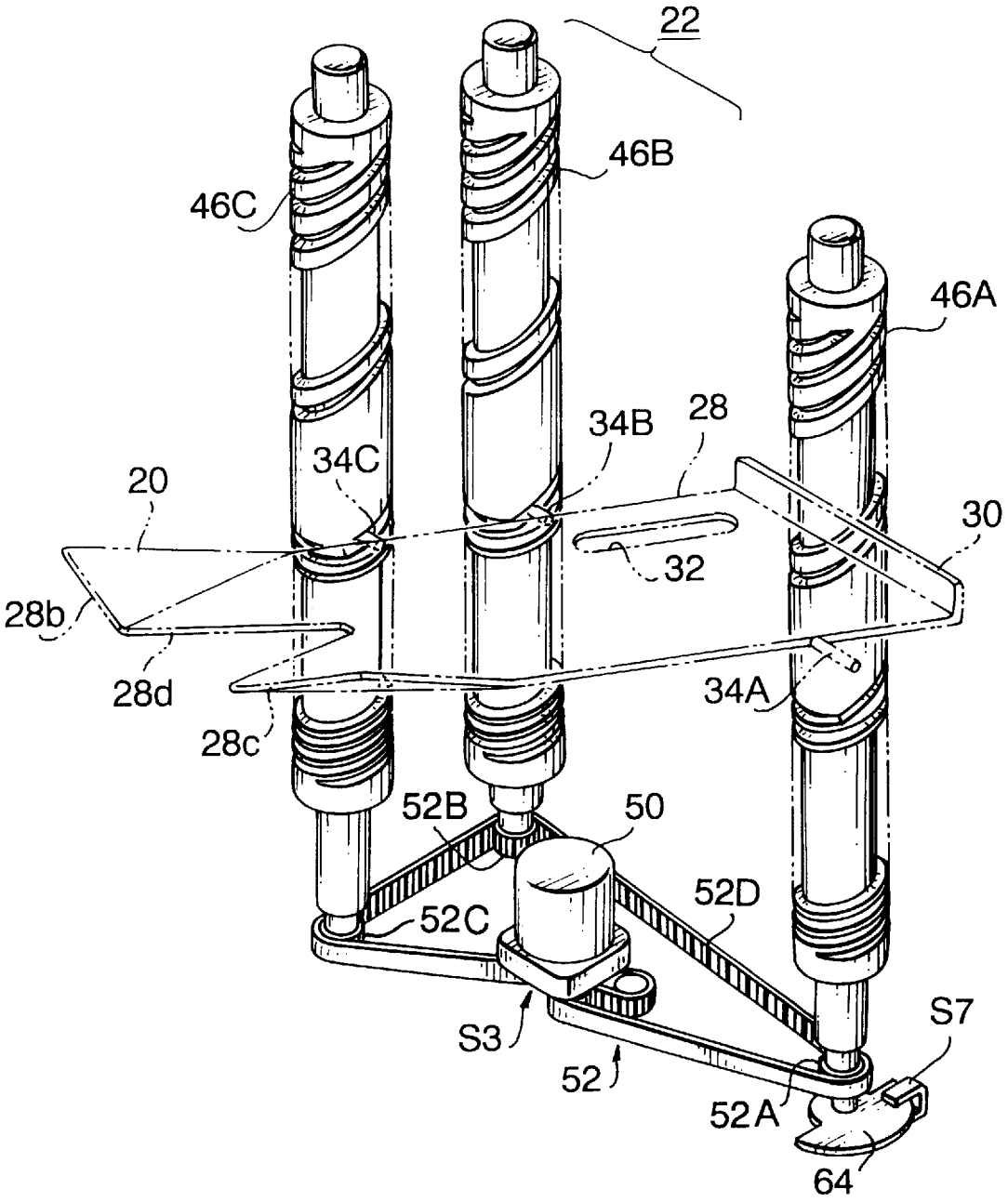
FIG. 3 is a perspective view showing the sorting tray drive mechanism.

As shown in FIGS. 2 and 3, the tray drive mechanism 22 includes the first to third screw rods 46A, 46B and 46C each of which extends vertically and is supported to be rotatable about a central vertical axis thereof, first to third support block 48A, 48B and 48C for rotatably supporting the first to third screw rods 46A, 46B and 46C, respectively, a drive motor 50 as a drive source, and a driving force transmitting mechanism 52 for transmitting the driving force of the drive motor 50 to the first through third screw rods 46A, 46B and 46C.

As shown in FIG. 2, a first elongated slot 54A is formed to the side plate 16*a* of the frame 16 on the front side. The first elongated slot 54A extends vertically and the first pin 34A attached to one lateral side surface of each sorting tray 20 is passing through the first elongated slot 54A. Second and third elongated slots 54B and 54C are formed to the side plate 16*b* of the frame 16 on the rear side. The second elongated slot 54B extends vertically and the second pin 34B attached to the other lateral side surface of each sorting tray 20 is passing through the second elongated slot 54B. The third elongated slot 54C extends vertically and the third pin 34C attached to the other lateral side surface of each sorting tray 20 is passing through the third elongated slot 54C.

The first support block 48A is formed in such a manner that the first screw rod 46A is rotatably supported about the its central vertical axis. The first support block 48A has an upright portion which is contacted to the outer surface of the side plate 16*a* of the frame 16 and to which an elongated slot 56A which is communicating with the elongated slot 54A formed to the side plate 16*a* is formed. The first pin 34A passing through the elongated slots 54A and 56A is engaged with a spiral groove 58A which is formed on the outer periphery of the first screw rod 46A.

The second support block 48B is formed in such a manner that the second screw rod 46B is rotatably supported about the its central vertical axis. The second support block 48B has an upright portion which is contacted to the outer surface of the side plate 16*b* of the frame 16 and to which an elongated slot 56B which is communicating with the elongated slot 54B formed to the side plate 16*b* is formed. The second pin 34B passing through the elongated slots 54B and 56B is engaged with a spiral groove 58B which is formed on the outer periphery of the second screw rod 46B.

The third support block 48C is formed in such a manner that the third screw rod 46C is rotatably supported about the its central vertical axis. The second support block 48C has an upright portion which is contacted to the outer surface of the side plate 16*b* and to which an elongated slot 56C which is communicating with the elongated slot 54C formed to the side plate 16*b* is formed. The third pin 34C passing through the elongated slots 54C and 56C is engaged with a spiral groove 58C which is formed on the outer periphery of the third screw rod 46C.

As shown in FIG. 3, the drive force transmitting mechanism 52 includes a drive pulley (not shown) which is fixed coaxially to a drive shaft of the drive motor 50, first through third driven pulleys 52A, 52*b* and 52*c* which are fixed coaxially to the lower end of the first through third screw rods 46*a*, 46B and 46C, respectively, and an endless timing belt 52D which is wound around the drive pulley and first through third driven pulleys 52A, 52B and 52C.

Since the tray drive mechanism 22 is constructed as described above in detail, the first through third screw rods 46A, 46B and 46C are rotated upon the drive of the drive motor 50.

[Description of spiral grooves 58A, 58B and 58C]

The first through third screw rods 46A, 46B and 46C have the first through third spiral grooves 58A, 58B and 58C, respectively. Note that the first through third spiral grooves 58A, 58B and 58C are formed to be identical to each other.

Accordingly, in the description about the spiral grooves 58*a,* 58B and 58C hereinafter, a spiral groove 58 is representing for the first through third spiral grooves 58A, 58B and 58C. Similarly, a pin 34 is representing for the first through third pins 34A, 34B and 34C and a screw rod 46 is representing for the first through third screw rods 46A, 46B and 46C.

Figure 6A:
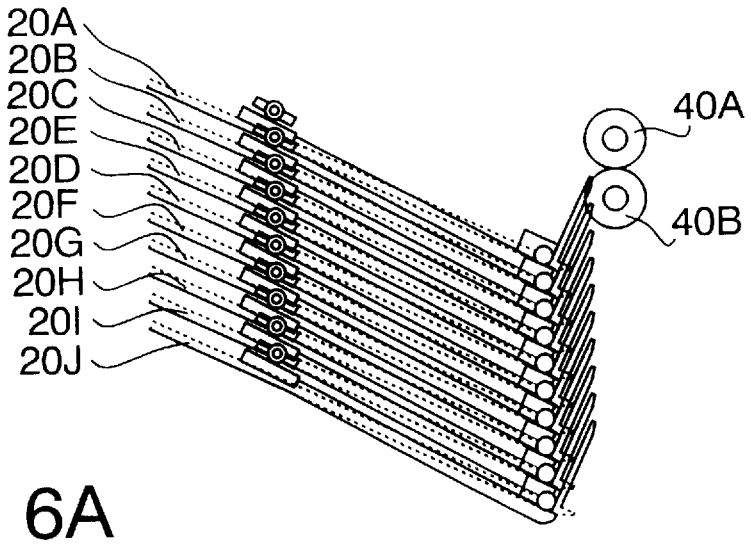
FIG. 6A is a front view showing the sorting trays at the receiving condition where each of sorting trays is in its home position.
Figure 6B:
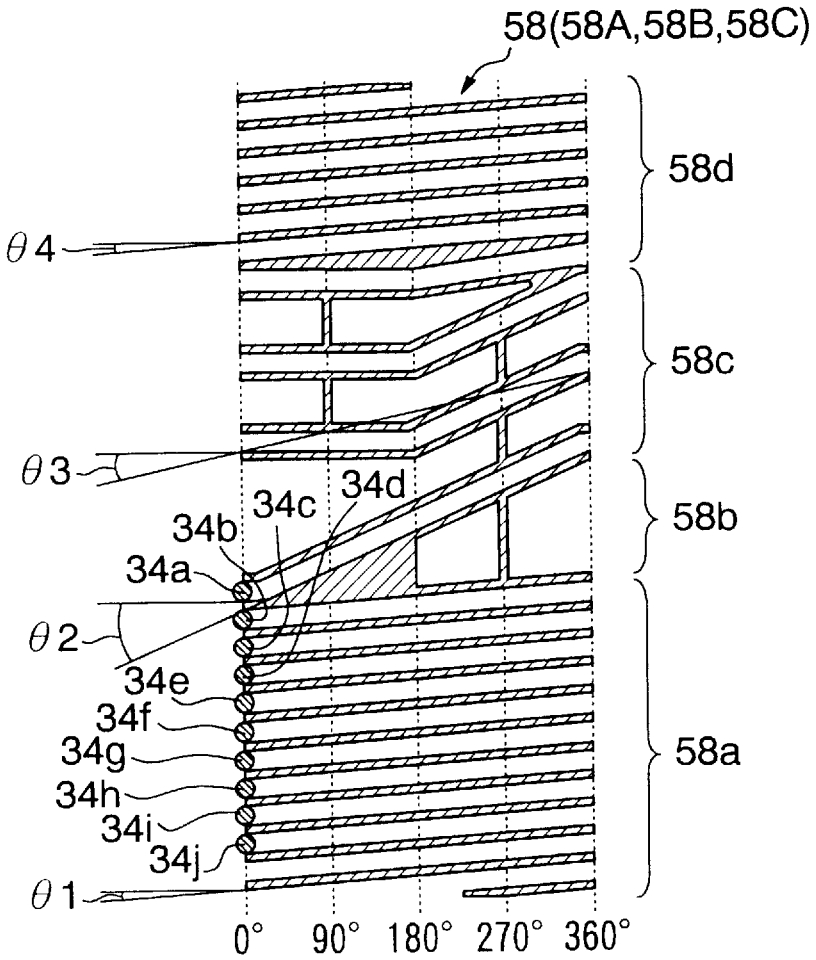
FIG. 6B is a developed view showing relationship between a spiral groove and pins of the sorting trays shown in FIG. 6A, that is, where the pin of the uppermost first sorting tray is engaged with the second groove portion of the spiral groove, and pins of the remaining nine sorting trays are engaged with the first groove portion of the spiral groove, while the screw rods are in a rotational position with 0 degree.

As shown in FIG. 6B, the spiral groove 58 is formed in such a manner that it is wound in a so-called "right direction". Accordingly, when the screw rod 46 is rotated in a right direction, that is, clockwise in FIG. 3, the pin 34 which is engaged with the spiral groove 58 is move upward, thereby lifting the sorting tray 20 to which the pin 34 is attached, while when the screw rod 46 is rotated in a left direction, that is, counterclockwise in FIG. 3, the pin 34 is move downward, thereby lowering the sorting tray 20.

The spiral groove 58 includes first through fourth groove portions 58*a* through 58*d.* The first groove portion 58*a* has of ten windings with a first lead angle θ1. The second groove porion 58*b* has a single winding with a second lead angle θ2. The third groove portion 58*c* has two windings with a third lead angle θ3. The fourth groove portion 58*d* has six windings with a fourth lead angle θ4.

More specifically, the each winding of the third groove portion 58*c* is comprised of a first half with a former lead angle θ31 and a second half with a latter lead angle θ32. The first half of the third groove portion 58*c* extends clockwise from a first rotational position of 0 degree to a second rotational position of 180 degrees of the screw rod 46 while the second half thereof extends clockwise from the second rotational position of 180 degrees to the first rotational position of 0 degree of the screw rod 46. As a result, the third lead angle θ3 is a complex of the former lead angle θ31 and the latter lead angle θ32 and the following equation (1) is satisfied:

$$\theta 3=(\theta 31+\theta 32)/2 \quad \ldots (1)$$

In the present embodiment, the former lead angle θ31 is set to be zero. Accordingly, the third lead angle θ3 is equal to (θ32/2). Furthermore, the following equations (2) and (3) are satisfied:

$$\theta 2=\theta 32 < \theta 1=\theta 4 \quad \ldots (2)$$

$$\theta 32<2*\theta 1 \quad \ldots (3)$$

Accordingly, when the screw rod 46 is rotated from a rotational position with 0 degree to a rotational position with 360 , degrees leads L1, L2, L3 and L4 of the sorting trays 20, the pins of which are engaged with the first through fourth groove portions 58*a* through 58*d,* respectively, are set in such a manner that the following equation (4) is satisfied:

$$L2<L3<L1=L4 \quad \ldots (4)$$

As described above, the first lead L1 is set to be minimum among the all leads L1 through L4, and an amount of the first lead L1 is defined in view of the maximum stacking sheet number refired on the sorting tray. Note that the position of the each of the sorting trays 20 (20A through 20J) as shown in FIGS. 6A and 6B, that is, where the pin 34 of the uppermost first sorting tray 20A is engaged with the second groove portion 58*b* of the spiral groove 58 and the pins 34 of the remaining nine sorting trays 20B through 20J are engaged with the first groove portion 58*a* of the spiral groove, is defined as a home position.

Figure 7A:
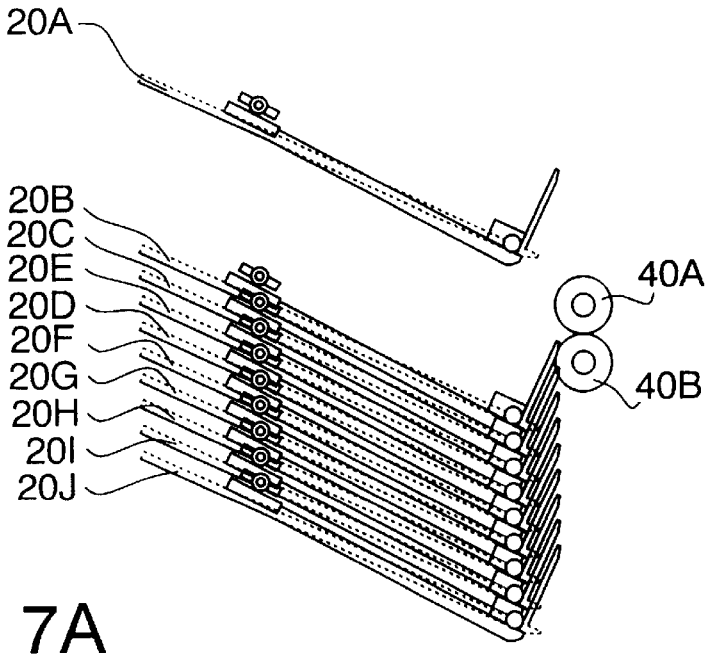
FIG. 7A is a front view showing the sorting trays at the receiving condition where all of the sorting trays are moved upward by a single lead from the state shown in FIG. 6A.
Figure 7B:
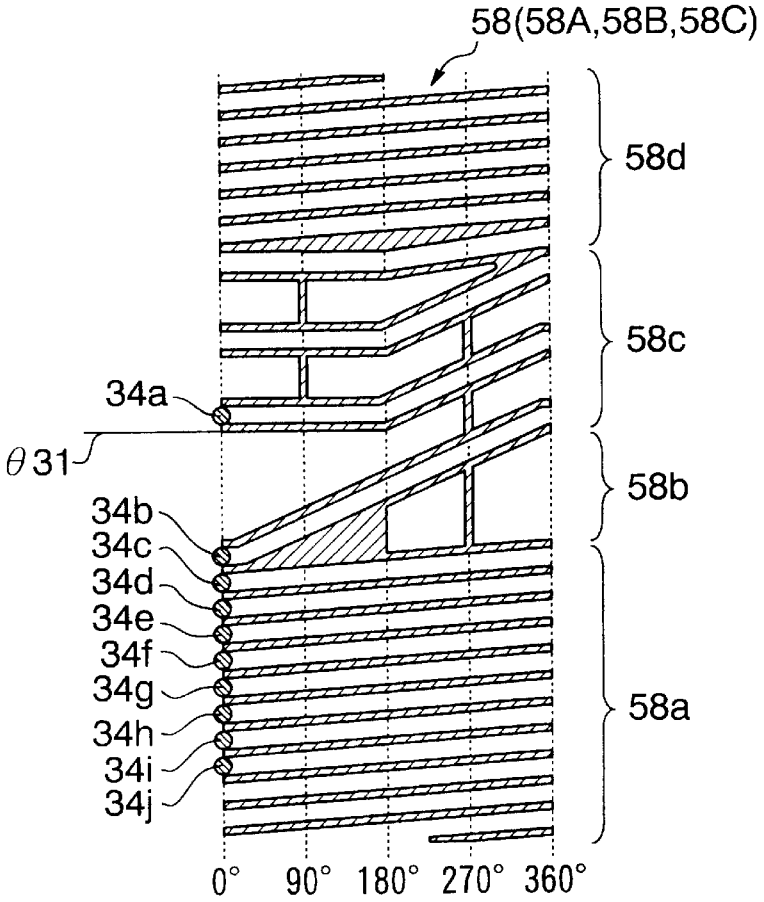
FIG. 7B is a developed view showing relationship between the spiral groove and pins of the sorting trays shown in FIG. 7A, that is, where the pin of the first sorting tray is engaged with the lower winding of the third groove portion of the spiral groove, the pin of the second sorting tray is engaged with the second groove portion, and pins of the remaining eight sorting trays are engaged with the first groove portion, while the screw rods are in the rotational position with 0 degree.

The second lead L2 is set to be maximum among the all leads L1 through L4, accordingly, the distance between the sorting tray 20, the pin 34 of which is engaged with the second groove portion 58*b,* and the sorting tray 20, the pin 34 of which is engaged with the first groove portion 38*a,* as shown in FIG. 7B, is widest among the other distance between adjacent sorting trays 20 without the sorting tray 20, the pin 34 of which is engaged with the second groove portion 58*b*. In the present embodiment, the sorting tray 20, the pin 34 of which is engaged with the second groove portion 58*b* is defined as the aforementioned sorting tray 20 in the receiving position.

The third groove portion 58*c* of the spiral groove 58 has the complex lead angle θ3 composed of the former lead angle θ31 and the latter lead angle θ32, and the former lead angle θ31 is set to be zero in the present embodiment. That is to say, the position of the pin 34 which is engaged with the third groove portion 58*c* is not changed while the screw rod 46 is rotated clockwise from the first rotational position of 0 degree to the second rotational position of 180 degrees, and is gradually raised as the screw rod is rotated clockwise from the second rotational position of 180 degrees by 180 degrees.

Accordingly, the distance between the sorting tray 20B in the receiving position and the sorting tray 20A just above the sorting tray in the receiving position is gradually shortened as the screw rod 46 is rotated clockwise from the rotational position with 0 degree to the rotational position with 180 degrees. Consequently, as compared a state where the screw rod 46 is stopped at the first rotational position of 0 degree as shown in FIG. 9B with a state where the screw rod 46 is stopped at the second rotational position of 180 degrees as shown in FIG. 14B, the number of the sorting trays 20 within the reference distance D of the state shown in FIG. 14B is greater than that of the state shown in FIG. 9B.

Figure 9A:
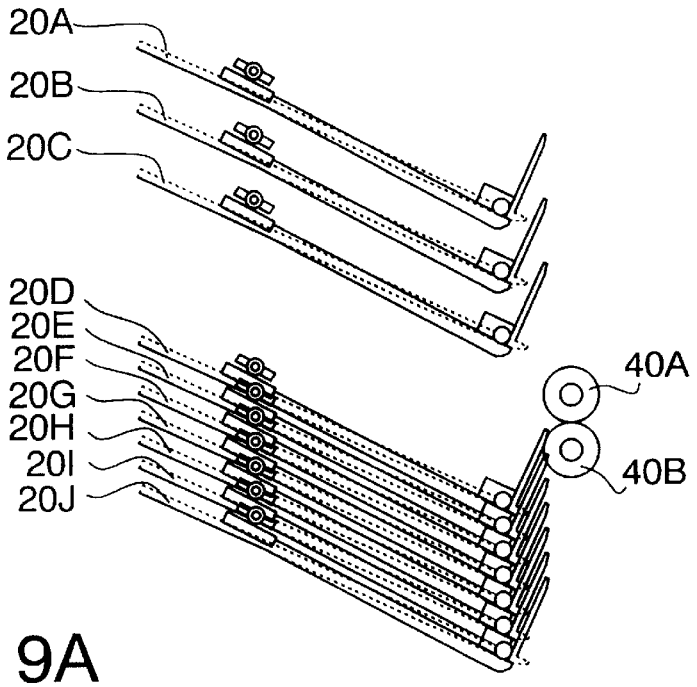
FIG. 9A is a front view showing the sorting trays at the receiving condition where all of the sorting trays are moved upward by a single lead from the state shown in Fig. SA.
Figure 9B:
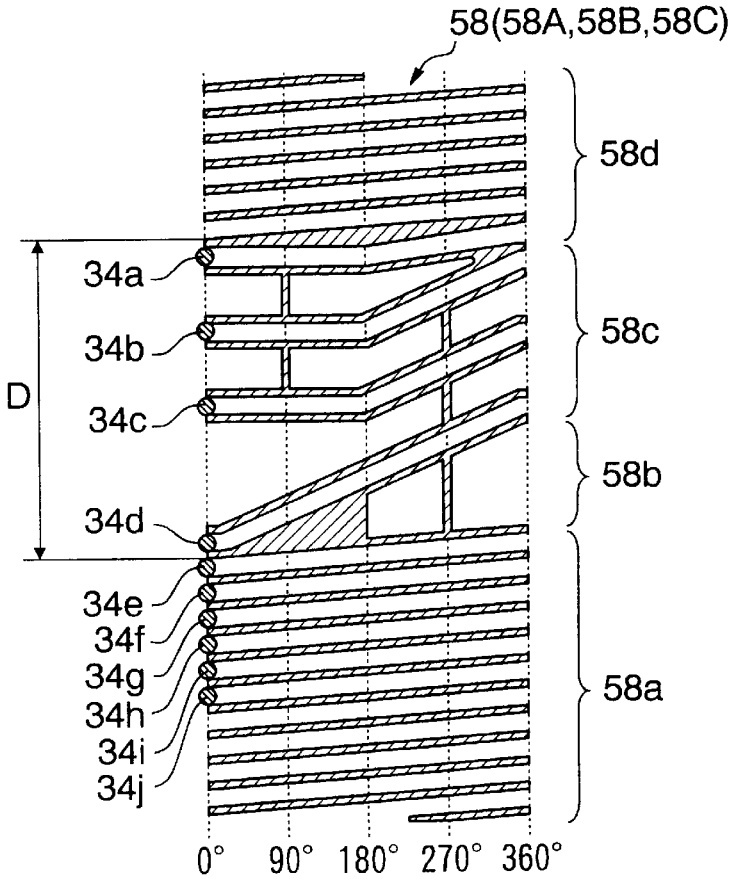
FIG. 9B is a developed view showing relationship between the spiral groove and pins of the sorting trays shown in FIG. 9A, that is, where the pin of the first sorting tray is engaged with the lowermost winding of the fourth groove portion of the spiral groove, the pins of the second and third sorting trays are engaged with the two windings of the third groove portion, respectively, the pin of the fourth sorting tray is engaged with the second groove portion, and pins of the remaining six sorting trays are engaged with the first groove portion, while the screw rods are in the rotational position with 0 degree.
Figure 10A:
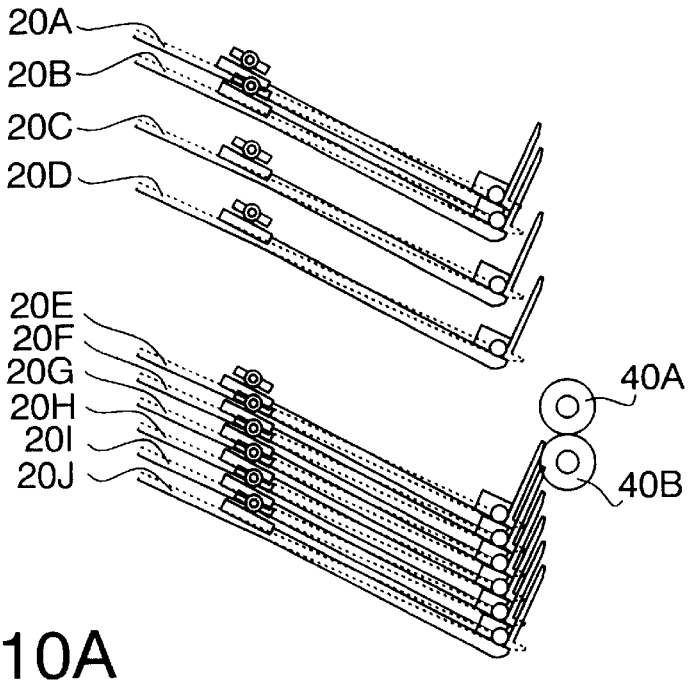
Fig. 10A is a front view showing the sorting trays at the receiving condition where all of the sorting trays are moved upward by a single lead from the state shown in FIG. 9A.
Figure 10B:
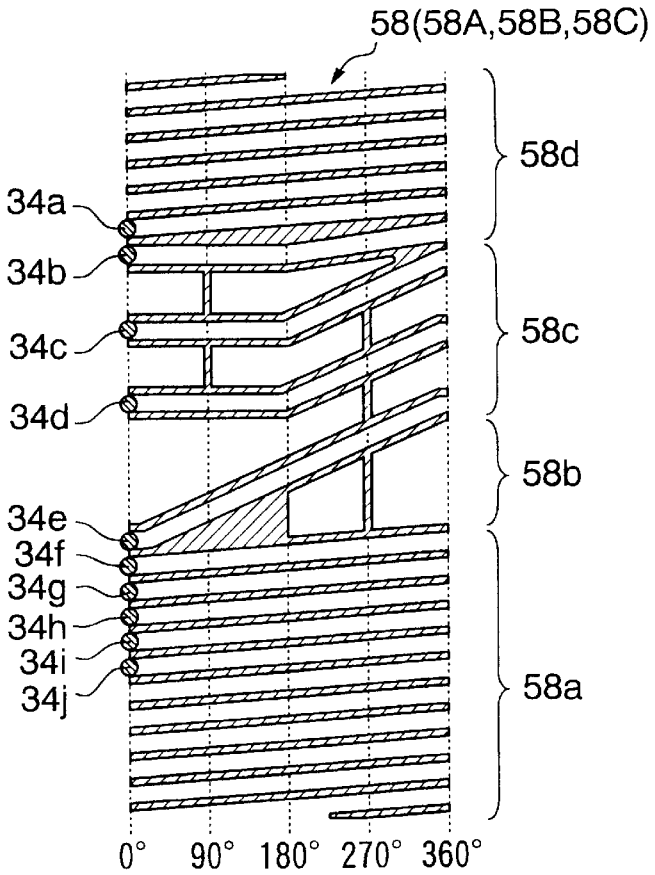
Fig. 10B is a developed view showing relationship between the spiral groove and pins of the sorting trays shown in Fig. 10A, that is, where the pins of the first and second sorting trays are engaged with lower two windings of the fourth groove portions, respectively, the pins of the third and fourth sorting trays are engaged with the two windings of the third groove portions, respectively, the pin of the fifth sorting tray is engaged with the second groove portion, and pins of the remaining five sorting trays are engaged with the first groove portion, while the screw rods are in the rotational position with 0 degree.
Figure 11A:
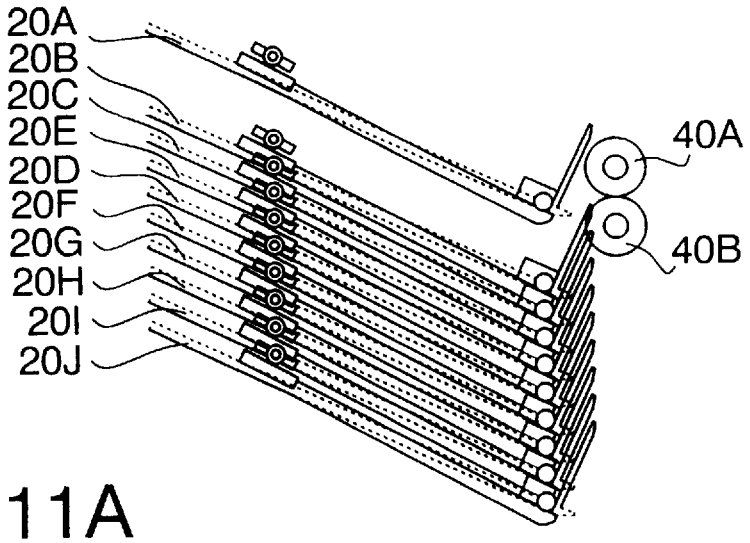
FIG. 11A is a front view showing the sorting trays at the take-out condition where all screw rods are rotated by 180 degrees from the state shown in FIG. 6A.
Figure 11B:
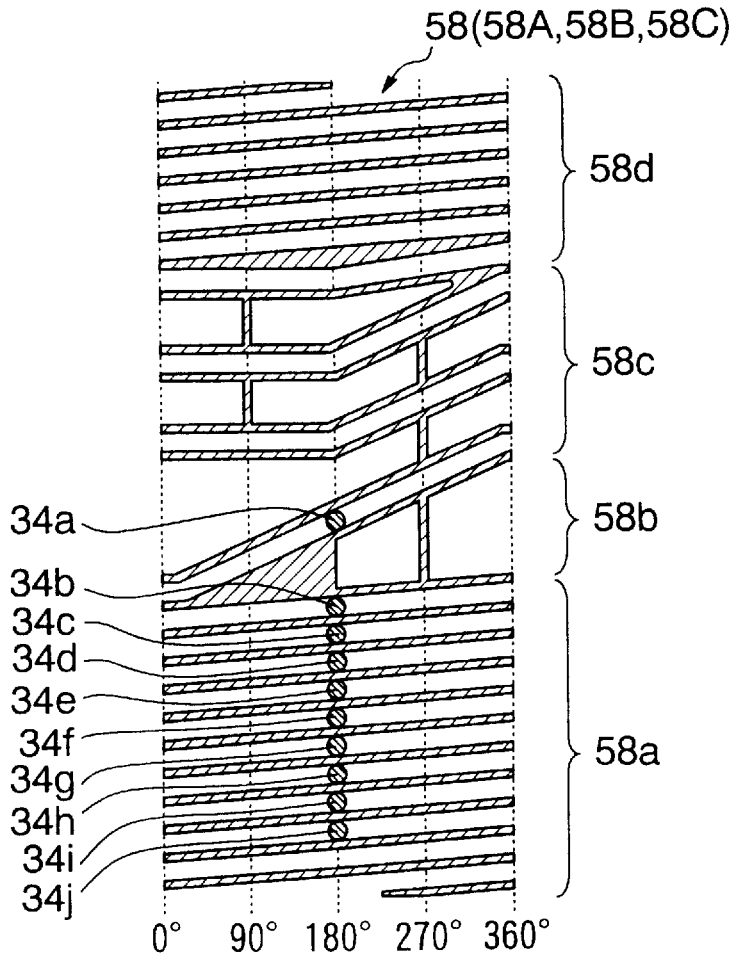
FIG. 11B is a developed view showing relationship between the spiral groove and pins of the sorting trays shown in Fig. 11A, that is, where the pin of the uppermost first sorting tray is engaged with the second groove portion, and the pins of the remaining sorting trays are engaged with the first groove portion, while the screw rods are in the rotational position with 180 degrees.
Figure 12A:
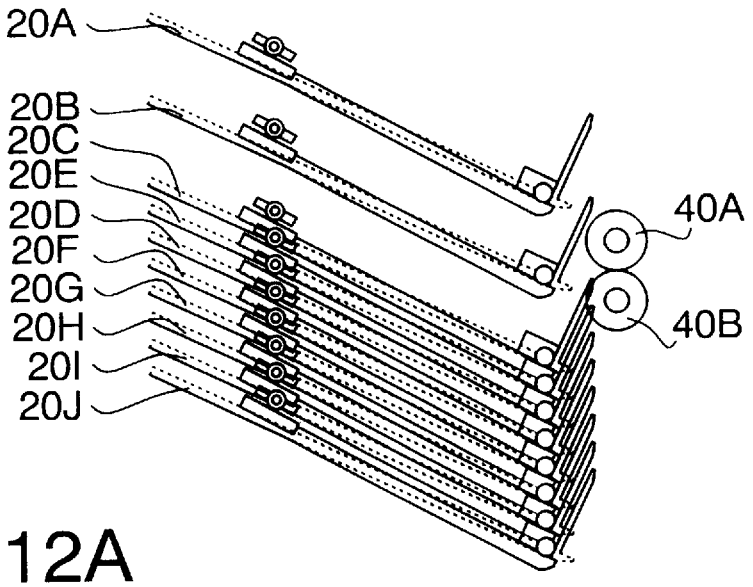
FIG. 12A is a front view showing the sorting trays at the take-out condition where all of the sorting trays are moved upward by a single lead from the state shown in FIG. 11A.
Figure 12B:
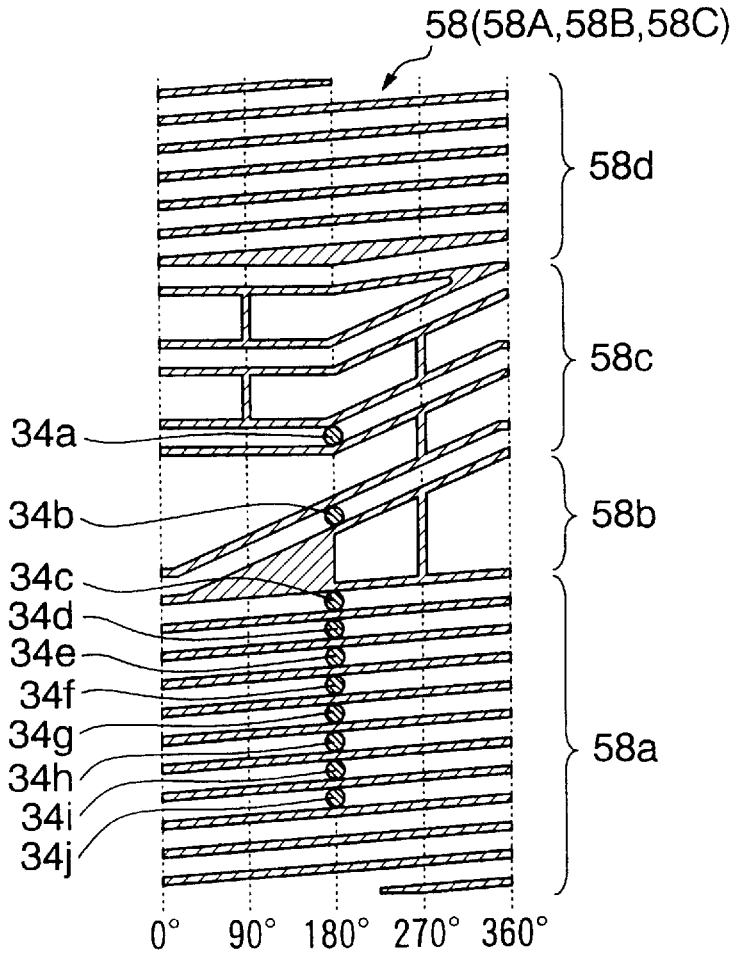
FIG. 12B is a developed view showing relationship between the spiral groove and pins of the sorting trays shown in FIG. 12A, that is, where the pin of the first sorting tray is engaged with the lower winding of the third groove portion, the pin of the second sorting tray is engaged with the second groove portion, and pins of the remaining eight sorting trays are engaged with the first groove portion, while the screw rods are in the rotational position with 180 degrees.
Figure 14A:
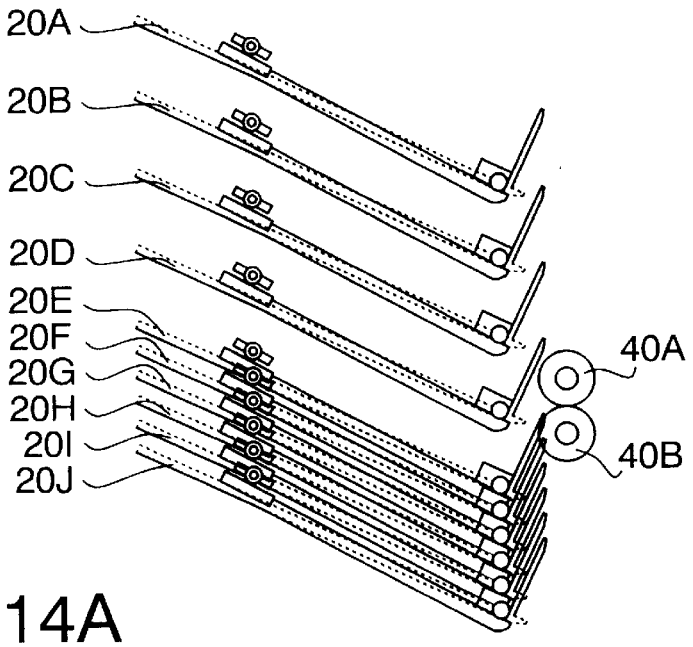
FIG. 14A is a front view showing the sorting trays at the take-out condition where all of the sorting trays are moved upward by a single lead from the state shown in FIG. 13A.
Figure 14B:
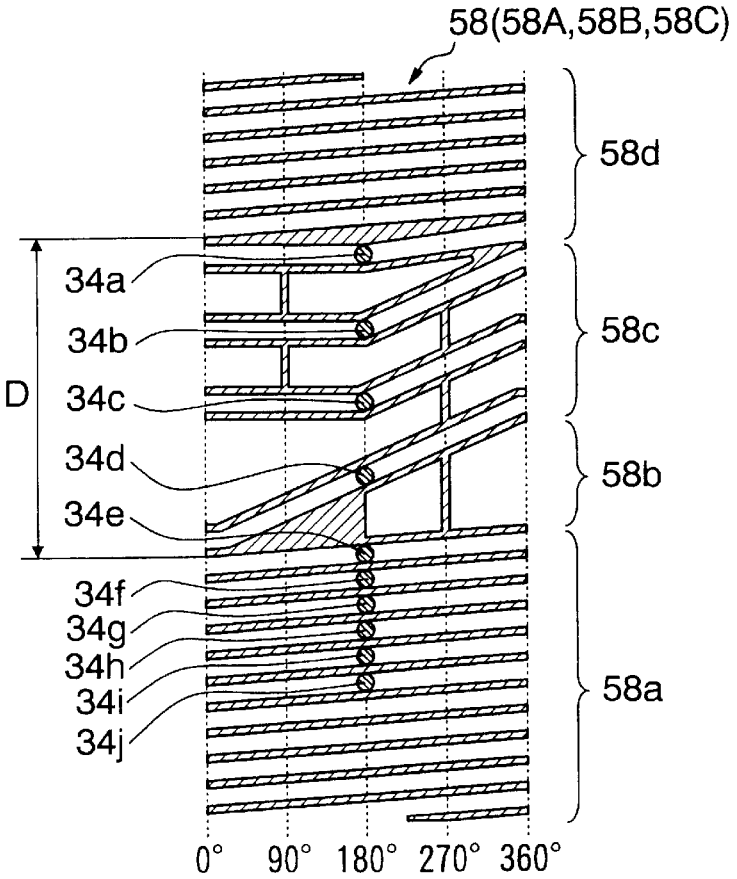
FIG. 14B is a developed view showing relationship between the spiral groove and pins of the sorting trays shown in FIG. 14A, that is, where the pin of the first sorting tray is engaged with the lowermost winding of the fourth groove portion of the spiral groove, the pins of the second and third sorting trays are engaged with two windings of the third groove portion, respectively, the pin of the fourth sorting tray is engaged with the second groove portion, and pins of the remaining six sorting trays are engaged with the first groove portion, while the screw rods are in the rotational position with 180 degrees.

More specifically, the number of the sorting trays 20 within the reference distance D where the screw rod 46 is stopped at the second rotational position of 180 degrees as shown in FIG. 14B is set to be five(5), while the number of the sorting trays 20 within the reference distance D where the screw rod 46 is stopped at the first rotational position of 0 degree is set to be four(4) as shown in FIG. 9B. Accordingly, the state where the screw rod 46 is stopped at the second rotational position of 180 degrees is preferable rather than the state where the screw rod 46 is stopped at the first rotational position of 0 degree, when the sheets are taken-out from the sorting trays 20.

As a result, in the present embodiment, the state where the screw rod 46 is stopped at the first rotational position of 0 degree as shown in FIGS. 6A to 10B is defined in a sheet receiving condition, while the state where the screw rod 46 is stopped at the second rotational position of 180 degrees as shown in FIGS. 11A to 15B is defined in a sheet take-out operation.

[Description of control system]

Now, description will be given about a control system including a control unit 60 with reference to FIG. 4.

The control unit 60 controls many actuators to execute the sorting operation and the grouping operation, based on a variety of control signals sent from the electrostatic copying machine 100 and a variety of signals detected by many sensors which will be described below.

At first, the description will be given about a plurality of sensors which are electrically connected to the control unit 60.

A first sensor S1 is provided to the feed motor 42, for detecting the rotating speed of the feed motor 42.

A second sensor S2 is arranged at a downstream side of the nip portion between the upper and lower outlet rollers 40A and 40*b* with respect to the receiving direction X of the copied sheet P, in other words, is provided between the distribute port 24 and the nip portion of the upper and lower outlet rollers 40A and 40B. The sensor S2 detects the passing of the copied sheet through the distribute port 24 when the trailing end of the copied sheet has passed by the sensor S2. The sensor S2 also functions as a counter for counting the number of the copied sheets which have been passed through the distribute port 24.

A third sensor S3 is provided to the drive motor 50, for detecting a rotation number of the screw rod 46 (or screw rods 46A, 46B and 46C). The sensor S3 also functions as a counter for counting the number of the sorting trays 20 which has been lifted up or raised down.

A fourth sensor S4 is provided for detecting that all copied sheets are completely taken out from sorting trays 20. The sensor S4 includes a pair of a light emitting element (LED) and a photodiode for being activated by a light which is emitted from the LED. One of the LED and the photodiode is provided above the recessed portion 28*d* of the first uppermost tray 20A which is located in the upper limit position and the other of the LED and the photodiode is provided below the recessed portion 28*d* of the tenth lowermost sorting tray 20J which is located in the lower limit position or home position. More precisely, The sensor S4 does not output a detected signal to the control unit 60 when there is at least one copied sheet on at least one sorting tray 20 but outputs the detected signal where there is no copied sheet on each of the sorting tray 20.

A fifth sensor S5 is provided for detecting that each of the sorting trays 20 is located its home position as shown in FIGS. 6A and 6B. More specifically, the sensor S5 does not output a detected signal to the control unit 60 when the lowermost tenth sorting tray 20J is located above the lower limit position but outputs the detected signal when the lowermost tenth sorting tray 20J is moved down to the lower limit position A sixth sensor S6 is provided for detecting that each of the sorting trays 20 is located its upper limit position. That is, the sensor S6 does not output a detected signal to the control unit 60 when the uppermost first sorting tray is located below an upper limit position but outputs the detected signal when the uppermost first sorting tray 20A is moved up to the upper limit position.

Note that the fifth and sixth sensors S5 and S6 are defined as tray position sensors.

[Description of detecting mechanisms]

Figure 5:
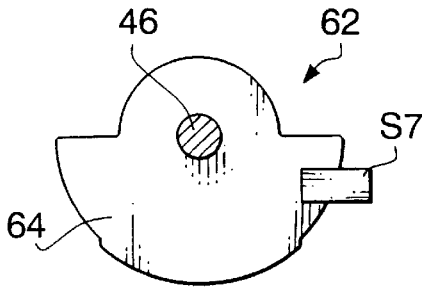
FIG. 5 is a plan view showing a cam member and a sensor for sensing a phase of a screw rod.

A screw rod phase detecting mechanism 62 for detecting a phase of the rotational position of the screw rod 46 is connected to the control unit 60. As shown in FIG. 5, the detecting mechanism 62 includes a detection sector 64 which is formed to one of the first through third screw rods 46A, 46B and 46C and the shape of which is semi-circular, and a seventh sensor S7 which detects the detection sector 64.

More specifically, the sensor S7 is constructed by a so called photo-interrupter including an LED and a photodiode, turned off when the detection sector 64 interrupts the sensor S7 and turned on when the detection sector 64 is out of the sensor S7. The detection sector 64 is formed to extend counterclockwise from the first rotational position of 0 degree of the screw rod 46 to the second rotational position of 180 degrees thereof.

Accordingly, the control unit 60 can determine the rotational positions of 0 degree and 180 degrees of the screw rod 46 based on the rotational direction of the screw rod 46 and the detected result from the sensor S7. That is to say,:

(1) the rotational position of the screw rod 46 is defined as 0 degree when the state of the sensor S7 is changed from "turned on" to "turned off" where the screw rod 46 is rotated clockwise, that is, where the sorting trays 20 are lift up;

(2) the rotational position of the screw rod 46 is defined as 180 degrees when the state of the sensor S7 is changed from "turned off" to "turned on" where the screw rod is rotated clockwise;

(3) the rotational position of the screw rod 46 is defined as 0 degree when the state of the sensor S7 is changed from "turned off" to "turned on" where the screw rod 46 is rotated counterclockwise, that is, where the sorting trays 20 are lowered; and (4) the rotational position of the screw rod 46 is defined as 180 degrees when the state of the sensor S7 is changed from "turned on" to "turned off" where the screw rod 46 is rotated counterclockwise.

Since the sorter 10 includes such a screw rod phase detecting mechanism 62, the control unit 60 can determine whether the screw rod 20 starts to rotate from the first rotational position of 0 degree (that is, from a position which is defined in a sheet receiving operation) or that of 180 degrees (that is, from a position which is defined in a sheet take-out operation).

Figure 13A:
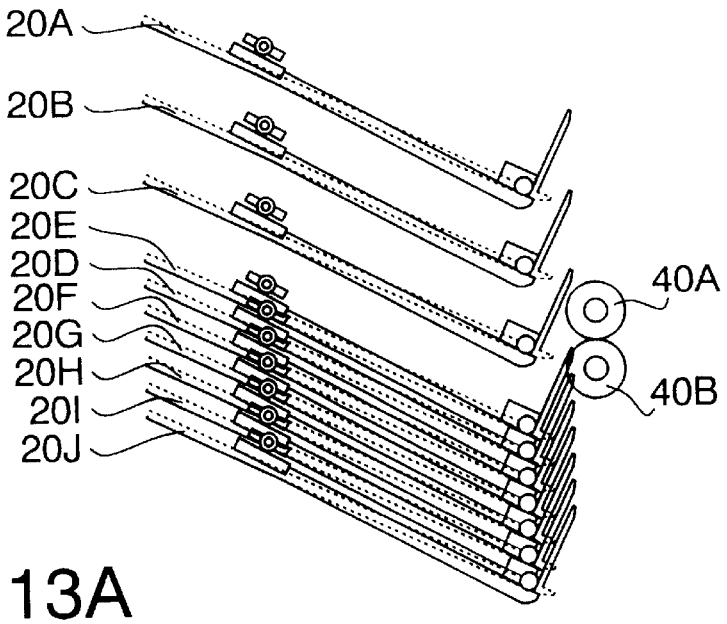
FIG. 13A is a front view showing the sorting trays at the take-out condition where all of the sorting trays are moved upward by a single lead from the state shown in FIG. 12A, that is, a basic position of the take-out condition.
Figure 13B:
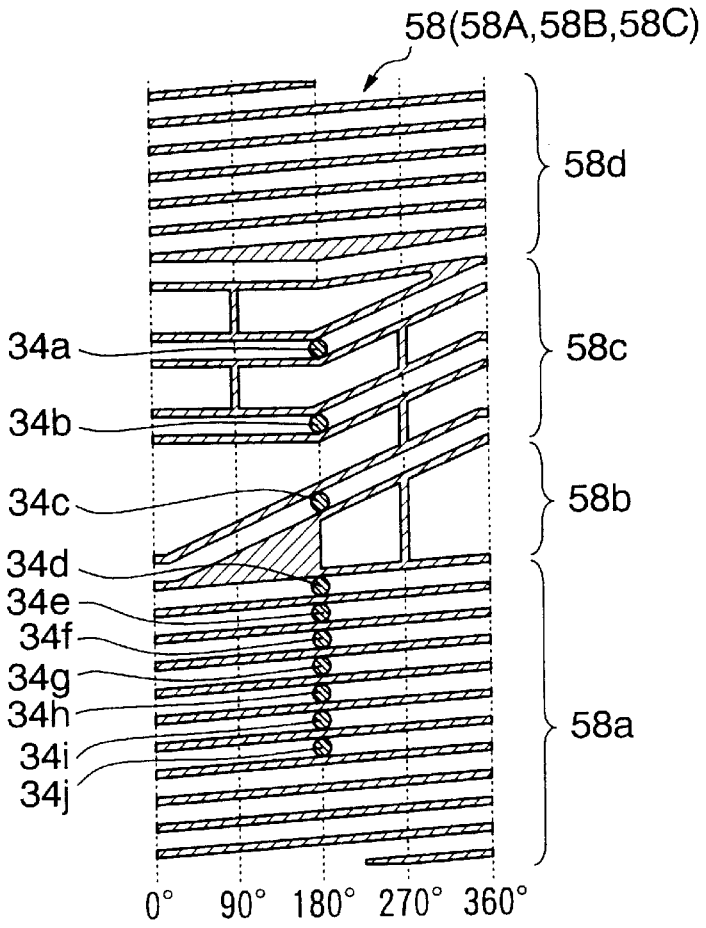
FIG. 13B is a developed view showing relationship between the spiral groove and pins of the sorting trays shown in FIG. 13A, that is, where the pins of the first and second sorting trays are engaged with the two windings of the third groove portion, respectively, the pin of the third sorting tray is engaged with the second groove portion, and pins of the remaining seven sorting trays are engaged with the first groove portion, while the screw rods are in the rotational position with 180 degrees.

A sheet detecting mechanism 66 is connected to the control unit 60 and is provided for detecting at least one copied sheet on the sorting tray 20 in a position corresponding to the receiving position, for example, the first sorting tray 20A which is located in a take-out basic position shown in FIGS. 13A and 13B. The sheet detecting mechanism 66 includes a swing lever 68 which is swingable in a vertical plane and upper end of which is rotatably supported to the upper portion of the frame 16, a detection sector 70 fixed to the proximal end of the swing lever 68, and a eighth sensor S8 which detects the detection sector 70.

More specifically, the swing lever 68 has a roller 72 at the distal end thereof, for allowing the smooth contact with the copied sheet on the sorting tray 20 in a sheet take-out position which is defined the uppermost sorting tray 20 shown in FIGS. 13A and 13B. The sensor S8 is constructed by a so-called photointerrupter including an LED and a photodiode, not shown. The sensor S8 is turned off when the detection sector 70 interrupts the sensor S8, and is turned on when the detection sector 70 is out of the sensor S8.

The detection sector 70 is formed in such a manner that sensor S8 will be turned off when the distal roller of the swing lever 68 rides on at least one copied sheet on the sorting tray which is located in the sheet take-out position, while it will be turned on when the distal roller of the swing lever 68 is dropped into the elongated through hole 32 which is formed to the receiving plate 28 of the sorting tray 20 since there is no copied sheet P, even though the sorting tray 20 is in any position, or when at least one copied sheet is remained on at least one sorting tray 20 which is lower than the sorting tray 20 in the sheet take-out position.

[Brief Description of operation of control unit 60]

Next, a description will be given about an operation of the control unit 60 with reference to FIGS. 6A through 15B. The control unit 60 selectively executes the receiving operation and the take-out operation which are selected upon a depression of a selective button (not shown) on a control panel of the copying machine 100.

At first, the description will be given about the receiving operation of the control unit 60 with reference to FIGS. 6A to 10B and then about the take-out operation thereof with reference to Figs. 11A to 15B.

[Description of receiving operation of control unit 60]

In the receiving operation, a non-sort mode and a sort mode are alternately defined upon an every depression of a mode switching button which is not shown but attached to the control panel. Note that the sorting treatment and the grouping treatment as described above are selectively executed when the sorting mode is selected.

In the receiving operation, the pins 34A, 34B and 34C of each of the sorting trays 20 are engaged with the respective spiral grooves 58A, 58B and 58C of the screw rods 46A, 46B and 46C in the first rotational position of 0 degree. That is to say, the screw rod 48 is stopped or to be stopped in a position where the pins 34A, 34B and 34C are engaged with the respective spiral grooves 58A, 58B and 58C of the screw rods 46A, 46B and 46C in the first rotational position of 0 degree when the receiving operation is executed. Note that, in the receiving operation, the sensor S8 is prohibited to execute the detection operation or the control unit 60 is set to ignore the detection result from the sensor S8.

Description of non-sort mode

Where the non-sort mode is selected, the home position shown in FIG. 6A is automatically defined under the control of the control unit 60. In the non-sort mode, the uppermost first sorting tray 20A is located in the receiving position, accordingly, the copied sheet distributed from the distribute port 24 is to be received on the first sorting tray 20A.

Since a space just above the first sorting tray 20A is set to be wide, the operator can easily grasp the stack of the copied sheets received on the first sorting tray 20A and take-out therefrom.

When it is detected that the number of the copied sheets received on the first sorting tray 20A becomes to a maximum number until which the copied sheets are allowed to be received thereon, the control unit 60 actuates the drive motor 50 so that the screw rods 46 are rotated clockwise and all sorting tray 20 are raised up by a single lead. As a result, the first sorting tray 20A is moved up to the position where each of the pins 34A through 34C of the sorting tray 20A becomes to be engaged with the lower winding of the third groove portion 58*c* of each of the spiral grooves 58A through 58C, and the second sorting tray 20B is also moved up to the position where each of the pins 34A through 34C of the sorting tray 20B becomes to be engaged with the second groove portion 58*b*of each of the spiral grooves 58A through 58C, as shown in FIGS. 7A and 7B.

As a result, the second sorting tray 20B is positioned in the receiving position, accordingly, the successive copied sheets are then received on the second sorting tray 20B in the receiving position.

Description of sort mode

Where the sort mode is selected, the control unit 60 discriminates whether or not the sorting treatment is selected.

Description of grouping treatment

Where the grouping treatment is selected upon a depression of a changeover button which is not shown but is attached to the control panel, each of the sorting trays 20 is automatically moved to its home position shown in FIG. 6A under the control of the control unit 60, as well as in the non-sort mode.

In the present embodiment, a case where predetermined numbers of copied sheets P, including four(4) pages, is supposed in the grouping treatment, as a matter of convenience.

In the grouping treatment of the sort mode, the uppermost first sorting tray 20A is located in the receiving position, accordingly, all copied sheets with the first page are transferred from the copying machine 100 and received on the first sorting tray 20A through the distribute port 24. When it is detected that the last copied sheet with the first page is received on the first sorting tray 20A based on the detection of the sensor S2, the control unit 60 starts to drive the drive motor 50 to rotate the screw rods 46A, 46B and 46C clockwise by one rotation (that is, 360 degrees). Accordingly, all of the sorting trays 20 are raised up by a single lead, and moved to the position shown in FIG. 7A.

Then, all copied sheets with the second page are transferred from the copying machine 100 and received on the second sorting tray 20B through the distribute port 24. When it is detected that the last copied sheet with the second page is received on the second sorting tray 20B based on the detection of the sensor S2, the control unit 60 starts to drive the drive motor 50 to rotate the screw rods 46A, 46B and 46C clockwise by one rotation. Accordingly, all of the sorting trays 20 are raised up by a single lead, and moved to the position shown in FIG. 8A.

Next, all copied sheets with the third page are transferred from the copying machine 100 and received on the third sorting tray 20C through the distribute port 24. When it is detected that the last copied sheet with the third page is received on the third sorting tray 20C based on the detection of the sensor S2, the control unit 60 starts to drive the drive motor 50 to rotate the screw rods 46A, 46B and 46C clockwise by one rotation. Accordingly, all of the sorting trays 20 are raised up by a single lead, and moved to the position shown in FIG. 9A.

Finally, all copied sheets with the last or fourth page are transferred from the copying machine 100 and received on the fourth sorting tray 20D through the distribute port 24. When it is detected that the last copied sheet with the last or fourth page is received on the fourth sorting tray 20D based on the detection of the sensor S2, the control unit 60 starts to further drive the drive motor 50 to rotate the screw rods 46A, 46B and 46C clockwise by one rotation. Accordingly, all of the sorting trays 20 are raised up by a single lead, and moved to and stopped in the position shown in Figs 10A and 10B.

As a result, in the grouping treatment in the sort mode, the first through fourth sets of the copied sheets P, each set including corresponding page, are collectively received on the first through fourth sorting trays 20A through 20D, respectively.

Description of sorting treatment

Where the sorting treatment is selected upon the depression of the changeover button, each of the sorting trays 20 is automatically moved to its home position shown in FIG. 6A under the control of the control unit 60, as well as in the non-sort mode and the grouping treatment in the sort mode.

In the present embodiment, a case where three(3) sets of copied sheets P, each set including four(4) pages, is supposed in the sorting treatment, as a matter of convenience.

In the sorting treatment of the sort mode, the uppermost first sorting tray 20A is located in the receiving position, accordingly, the first copied sheet with the first page is transferred from the copying machine 100 and is received on the first sorting tray 20A through the distribute port 24. When it is detected that the first copied sheet with the first page is received on the first sorting tray 20A based on the detection of the sensor S2, the control unit 60 starts to drive the drive motor 50 to rotate the screw rods 46A, 46B and 46C clockwise by one rotation (that is, 360 degrees). Accordingly, all of the sorting trays 20 are raised up by a single lead, and moved to the position shown in FIG. 7A.

Then, the second copied sheet with the first page is transferred from the copying machine 100 and is received on the second sorting tray 20B from the distribute port 24. When it is detected that the second copied sheet with the first page is received on the second sorting tray 20B based on the detection of the sensor S2, the control unit 60 starts to drive the drive motor 50 to rotate the screw rods 46A, 46B and 46C clockwise by one rotation. Accordingly, all of the sorting trays 20 are raised up by a single lead, and moved to the position shown in Fig. SA.

Next, the last or third copied sheet with the first page is transferred from the copying machine 100 and is received on the third sorting tray 20C through the distribute port 24. When it is detected that the last copied sheet with the first page is received on the third sorting tray 20C based on the detection of the sensor S2, the first copied sheet with the second page is transferred from the copying machine 100 and is received on the third sorting tray 20C through the distribute port 24.

When it is detected that the last copied sheet with the third page is received on the third sorting tray 20C based on the detection of the sensor S2, the control unit 60 starts to drive the drive motor 50 to rotate the screw rods 46A, 46B and 46C counterclockwise by one rotation. Accordingly, all of the sorting trays 20 are moved down by a single lead, and moved to the position shown in FIG. 7A.

Then, the second copied sheet with the second page is transferred from the copying machine 100 and is received on the second sorting tray 20B through the distribute port 24. When it is detected that the second copied sheet with the second page is received on the second sorting tray 20B based on the detection of the sensor S2, the control unit 60 starts to drive the drive motor 50 to rotate the screw rods 46A, 46B and 46C counterclockwise by one rotation. Accordingly, all of the sorting trays 20 are moved down by a single lead, and moved to the position shown in FIG. 6A.

Then, the last or third copied sheet with the second page is transferred from the copying machine 100 and is received on the first sorting tray 20A through the distribute port 24. When it is detected that the last or third copied sheet with the second page is received on the second sorting tray 90B based on the detection of the sensor S2, the first copied sheet with the third page is transferred from the copying machine 100 and is received on the first sorting tray 20A through the distribute port 24.

When it is detected that the first copied sheet with the third page is received on the first sorting tray 20A based on the detection of the sensor S2, the control unit 60 starts to drive the drive motor 50 to rotate the screw rods 46A, 46B and 46C clockwise by one rotation. Accordingly, all of the sorting trays 20 are raised up by a single lead, and moved to the position shown in FIG. 7A.

Finally, the last or third copied sheet with the last or fourth page is transferred from the copying machine 100 and is received on the first sorting tray 20A. When it is detected that the last copied sheet with the last or fourth page is received on the first sorting tray 20A based on the detection of the sensor S2, the sorting treatment is completed.

As a result, in the sorting treatment in the sort mode, the first through third sets of the copied sheets P, each set including all of the first through fourth pages, are collectively received on the first through third sorting trays 20A through 20C, respectively.

Note that, if a case where three(3) sets of copied sheets P, each set including five(5) pages, is supposed in the sorting treatment, the last copied sheet with the last or fifth page is received on the third sorting tray 20C.

[Description of take-out operation of control unit 60]

When the operator depresses the selective button in the condition where the receiving operation has been completed, the take-out operation is alternately executed.

When the take-out operation is initiated, the control unit 60 starts to actuate the drive motor 50 to rotate the screw rods 46a, 46B and 46C from the first rotational position of 0 degree to the second rotational portion of 180 degrees by 180 degrees. Accordingly, in the take-out operation, the pins 34A, 34B and 34C of each of the sorting trays 20 are engaged with the respective spiral grooves 58A, 58B and 58C of the screw rods 46A, 46B and 46C in the second rotational position of 180 degrees. That is to say, the screw rod 48 is stopped or to be stopped in a position where the pins 34A, 34B and 34C are engaged with the respective spiral grooves 58A, 58B and 58C of the screw rods 46A, 46B and 46C in the second rotational position of 180 degrees when the take-out operation is executed. Note that the sensor S8 is activated and the control unit 60 execute the control operation with reference to the detection result from the sensor S8.

In a basic concept, the take-out operation is set to be started from the state shown in FIGS. 13A and 13B, where the pins 34A, 34B and 34C of the first and second sorting trays 20A and 20B are engaged with the two windings, respectively, of the third groove portion 58c of each of the spiral grooves 58A, 58B and 58C, the pins 34A, 34B and 34C of the third sorting tray 20C are engaged with the second groove portion 58*b*of each of the spiral grooves 58A, 58B and 58C, and pins 34A, 34B and 34C of each of the remaining seven sorting trays 20D through 20J are engaged with the first groove portion 58*a*of each of the spiral grooves 58A, 58B and 58C, while the screw rods 46A, 46B and 46C are in the rotational position with 180 degrees.

In other words, all of the sorting trays 20 are basically moved to the base position shown in FIGS. 13A and 13B prior to the start of the take-out operation.

Take-out operation of the copied sheets which are subjected to the grouping treatment in the sort mode In a case where the page number is equal to or more than five(5)

Figure 15A:
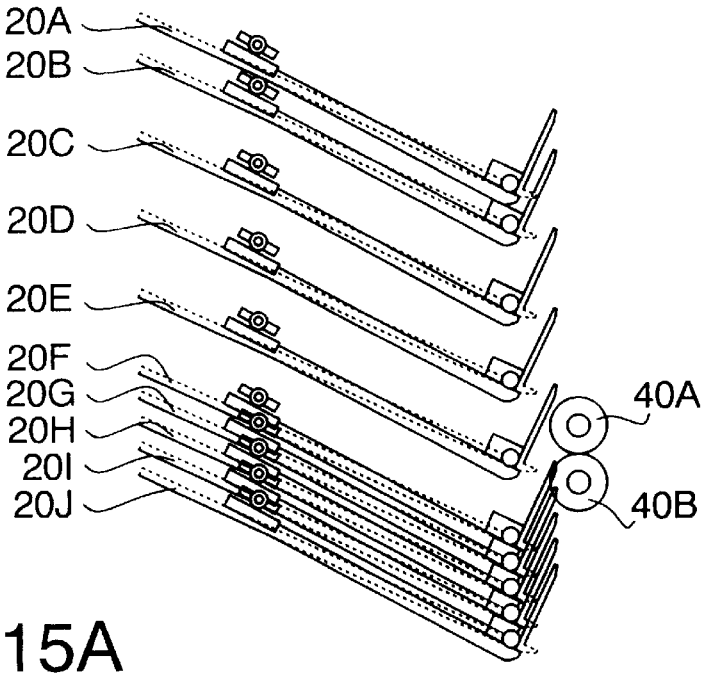
FIG. 15A is a front view showing the sorting trays at the take-out condition where all of the sorting trays are moved upward by a single lead from the state shown in FIG. 14A.
Figure 15B:
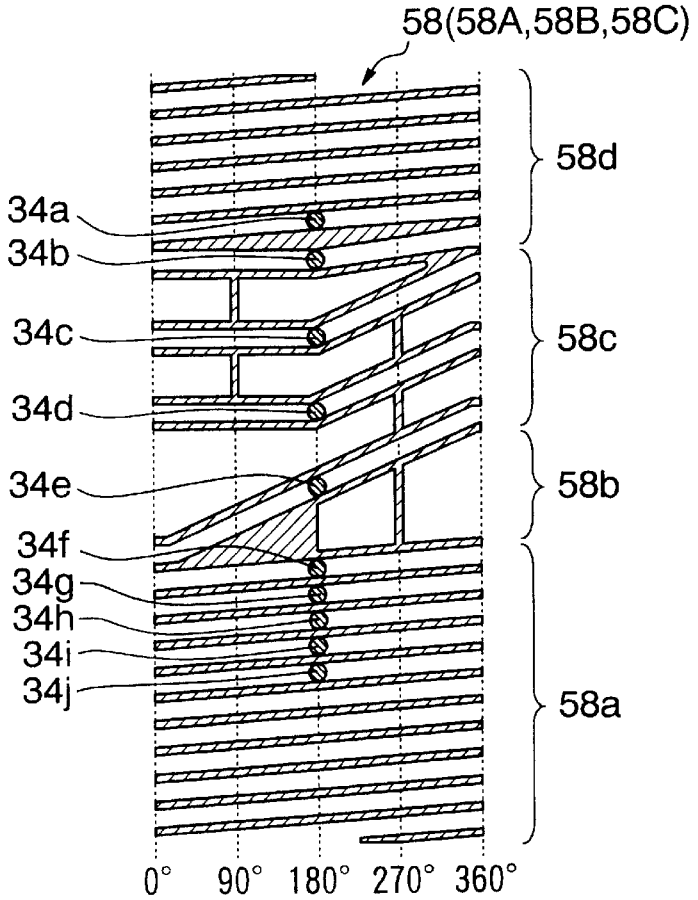
FIG. 15B is a developed view showing relationship between the spiral groove and pins of the sorting trays shown in FIG. 15A, that is, where the pins of the first and second sorting trays are engaged with lower two windings of the fourth groove portion, the pins of the third and fourth sorting trays are engaged with two windings of the third groove portion, the pin of the fifth sorting tray is engaged with the second groove portion, and pins of the remaining five sorting trays are engaged with the first groove portion, while the screw rods are in the rotational position with 180 degrees.

When the grouping treatment of the receiving operation has been completed in the case where the page number is equal to or more than five(5), all of the sorting trays 20 are stopped in a position higher than the position shown in FIGS. 15A and 15B. In the condition shown in FIGS. 15A and 15B, it is difficult to take out a set of the copied sheets with the second page which are received on the second sorting tray 20B.

Accordingly, the control unit 60 actuates to drive the drive motor 50 to rotate the screw rods 46A, 46B and 46C counterclockwise, thereby lowering the sorting trays 20. When the sensor S8 is turned on in the lowering operation, then the control unit 60 actuates the drive motor 50 to rotate the screw rods 46A, 46B and 46C clockwise, thereby raising the sorting trays 20.

When the sensor S8 is turned off in the raising operation, the control unit 60 controls to stop the drive of the drive motor 50, whereby the sorting trays 20 are located in the base position shown in FIGS. 13A and 13B.

In the state shown in FIGS. 13A and 13B, the operator can take out the three sets of the copied sheets from the first through third sorting trays 20A through 20C. When the three sets of the copied sheets are taken out from the sorting trays 20A through 20C, the sensor S8 becomes to be turned on. Upon the detection of the sensor S8 being turned on, the control unit 60 starts to actuate the drive motor 50 to rotate the screw rods 46A, 46B and 46C clockwise, thereby raising the sorting trays 20.

When the sensor S8 is turned off in the raising operation, the control unit 60 controls to stop the drive of the drive motor 50, whereby further three sets of the copied sheets received on the fourth through sixth sorting trays 20D through 20F are allowed to be taken out therefrom.

Note that when the sensor S4 becomes not to output the detected signal to the control unit 60 at any timing in the takeout operation, it is determined that all sets of the copied sheets have been taken out from the all sorting trays 20 and therefore the control unit 60 stops the control procedure of the take-out operation.

In a case where the page number is less than five(5)

When the grouping treatment of the receiving operation has been completed in the case where the page number is less than five(5), all of the sorting trays 20 are stopped in a position lower than the position shown in FIGS. 14A and 14B. In the condition shown in FIGS. 14A and 14B, it is possible to directly take out all sets of the copied sheets on the sorting trays 20 which are in the receiving condition. Accordingly, the control unit 60 does not actuate the drive motor 50 any more.

Take-out operation of the copied sheets which are subjected to the sorting treatment in the sort mode In a case where the page number is odd and the set number is three(3)

Figure 8A:
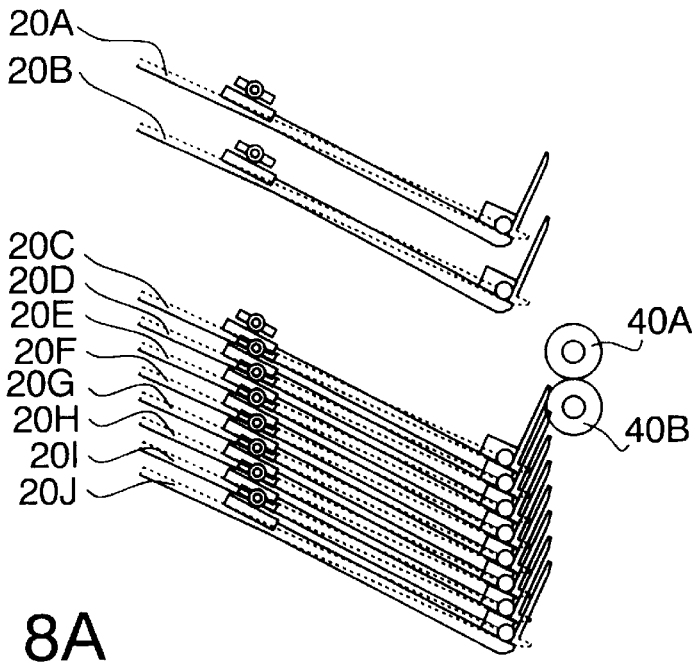
FIG. 8A is a front view showing the sorting trays at the receiving condition where all of the sorting trays are moved upward by a single lead from the state shown in FIG. 7A.
Figure 8B:
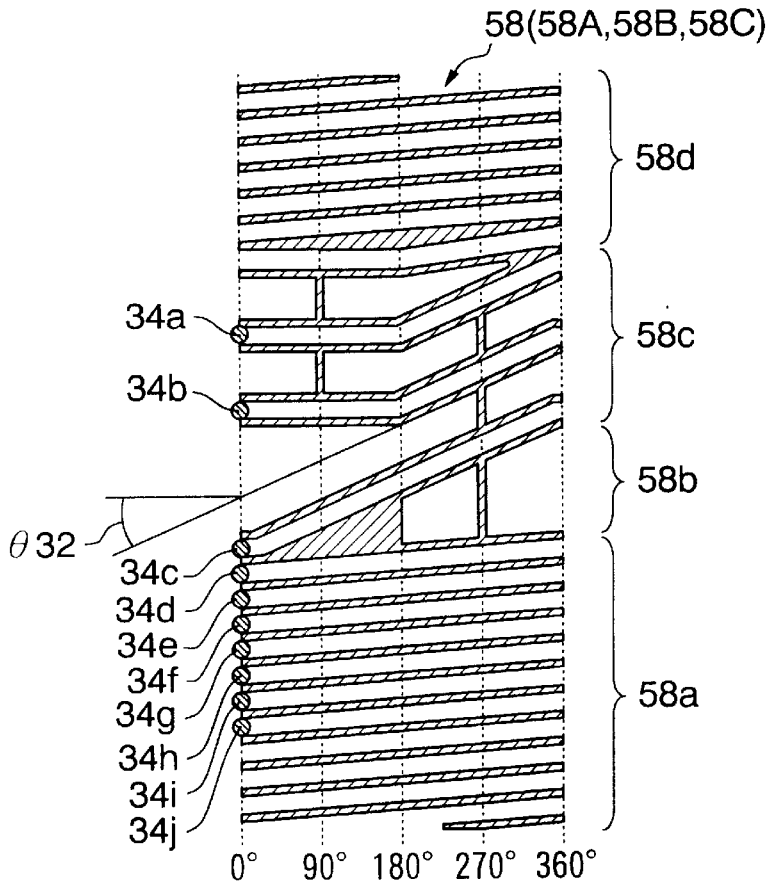
FIG. 8B is a developed view showing relationship between the spiral groove and pins of the sorting trays shown in FIG. 8A, that is, where the pins of the first and second sorting trays are engaged with two windings of the third groove portion, respectively, the pin of the third sorting tray is engaged with the second groove portion, and s of the remaining seven sorting trays are engaged with the first groove portion, while the screw rods are in the rotational position with 0 degree.

When the sorting treatment of the receiving operation is completed in the case where the page number is odd and the set number is three, all of the sorting trays 20 are stopped in a position shown in FIGS. 8A and 8B. Accordingly, the base position shown in FIGS. 13A and 13B is automatically defined whereby the control unit 60 actuates the drive motor 50 to rotate the screw rods 46A, 46B and 46C clockwise by 180 degrees in order to change the operation from the receiving condition to the take-out condition. As a result, it is not necessary to move up nor down in the case where the page number is odd and the set number is three.

In a case where the page number is odd and the set number is more than three(3)

When the sorting treatment of the receiving operation is completed in the case where the page number is odd and the set number is more than three (for example, four), all of the sorting trays 20 are stopped in the position shown in FIGS. 9A and 9B. Accordingly, when the control unit 60 actuates the drive motor 50 to rotate the screw rods 46A, 46B and 46C clockwise by 180 degrees in order to change the operation from the receiving condition to the take-out condition, the sorting trays 20 are raised to the position shown in FIGS. 14A and 14B.

As a result, it is necessary to move down the sorting trays 20 in the case where the page number is odd and the set number is more than three, prior to execute the take-out operation. Accordingly, the control unit 60 actuate the drive motor 50 to rotate the screw rods 46A, 46B and 46C counterclockwise, thereby lowering the sorting trays 20.

When the sensor S8 is turned on in the lowering operation, then the control unit 60 actuates the drive motor 50 to rotate the screw rods 46A, 46B and 46C clockwise, thereby raising the sorting trays 20, until the sensor S8 is to be turned off in the raising operation. The control unit 60 controls to stop the drive of the drive motor 50 upon the detection of being turned off of the sensor S8, whereby the sorting trays 20 are located in the base position shown in FIGS. 13A and 13B.

The operator can take out three sets of the copied sheets from the first through third sorting trays 20A through 20C.

When the three sets of the copied sheets are taken out, the sensor S8 is then turned on. Upon the detection of the sensor S8 being turned on, the control unit 60 starts to actuate the drive motor 50 to rotate the screw rods 46A, 46B and 46C clockwise, thereby raising the sorting trays 20.

When the sensor S8 is turned off in the raising operation, the control unit 60 controls to stop the drive of the drive motor 50, whereby further three sets of the copied sheets received on the fourth through sixth sorting trays 20D through 20F are allowed to be taken out therefrom.

Note that when the sensor S4 becomes not to output the detected signal to the control unit 60 at any timing in the takeout operation, it is determined that all sets of the copied sheets have been taken out from the all sorting trays 20 and therefore the control unit 60 stops the control procedure of the take-out operation.

Especially, if the sorting treatment of the receiving operation is completed in the case where the page number is odd and the set number is four, the operator can take out all of four sets of the copied sheets from the first through fourth sorting trays 20A through 20D because there is no copied sheet on the fifth sorting tray 20E.

In a case where the page number is even or where the page number is odd and the set number is equal to or less than three(3)

When the sorting treatment of the receiving operation is completed in the case where the page number is even, all of the sorting trays 20 are stopped in a position shown in FIGS. 6A and 6B, or where the page number is odd and the set number is two(2), all of the sorting trays 20 are stopped in a position shown in FIGS. 8A and 8B, or where the page number is odd and the set number is one(1),all of the sorting trays 20 are stopped in a position shown in FIGS. 9A and 9B.

Accordingly, when the control unit 60 actuates the drive motor 50 to rotate the screw rods 46A, 46B and 46C clockwise by 180 degrees in order to change the operation from the receiving condition to the take-out condition, the sorting trays 20 are raised to the position shown in FIGS. 11A and 11B or FIGS. 12A and 12B or FIGS. 13A and l3B.

As a result, it is necessary to move up the sorting trays 20, prior to execute the take-out operation. Accordingly, the control unit 60 actuate the drive motor 50 to rotate the screw rods 46A, 46B and 46C clockwise, thereby raising the sorting trays 20.

When the sensor S8 is turned off in the raising operation, then the control unit 60 controls to stop the drive of the drive motor 50 upon the detection of being turned off of the sensor S8, whereby the sorting trays 20 are located in the base position shown in FIGS. 13A and 13B.

The operator can take out three (at most) sets of the copied sheets from the first through third (at most) sorting trays 20A through 20C.

If the sensor S4 still outputs the detected signal to the control unit 60 even though the take-out operation is executed, it is determined that other sets of copied sheets are remained on the sorting trays 20. Accordingly, the control unit 60 actuates the drive motor 50 to rotate the screw rods 46A, 46B and 46C clockwise, thereby raising the sorting trays 20 until the sensor S8 becomes to be turned on.

When the sensor S8 is turned off in the raising operation, the control unit 60 controls to stop the drive of the drive motor 50, whereby further three sets of the copied sheets received on the fourth through sixth sorting trays 20D through 20F are allowed to be taken out therefrom.

When the sensor S4 becomes not to output the detected signal to the control unit 60 at any timing in the take-out operation, it is determined that all sets of the copied sheets have been taken out from the all sorting trays 20 and therefore the control unit 60 stops the control procedure of the take-out operation.

[Description of modification]

In the aforementioned embodiment, the sorter 10 is connected to the electrostatic copying machine 100. However, the present invention is not limited such a connection and the sorter according to the present invention is capable of connecting to a printer or image forming apparatus such as a sheet processor.

In the aforementioned embodiment, the sorter 10 is constructed to include three screw rods 46A, 46B and 46C. However, the present invention is not limited to such a construction, and the sorter according to the present invention may include two screw rods which are arranged on both side of the sorting trays.

In the aforementioned embodiment, the sorting trays 20 are arranged at intervals of a single lead and the screw rod is stopped at two rotational positions per one rotation thereof. However, the present invention is not limited to such an arrangement, and the sorter according to the present invention may include sorting trays which are arranged at intervals of at least two leads. In this modification, the screw rod may be stopped at a plurality of rotational positions per a plurality of rotations thereof or at a rotational position per one rotation thereof.

In the aforementioned embodiment, the screw rods 46A, 46B and 46C are set to be stopped at two rotational positions (that is, 0 degree and 180 degrees). However, the present invention is not limited to such a setting, and the screw rod of the present invention may be stopped at three or more rotational positions per one rotation thereof and may differ the lead angles between the adjacent rotational positions.

Although the screw rod phase detecting mechanism 62 for detecting the phase of the rotational position of the screw rods 46A, 46B and 46C includes the detection sector 64, the shape of which is semi-circular in the aforementioned embodiment, the shape of the sector in this modification may be formed to have a plurality of protrusions so that a plurality of phases should be discriminated.

In the aforementioned embodiment, the distance between the adjacent sorting trays in the receiving condition is set to be larger than that in the take-out condition. However, the present invention is not limited to such a setting, and the distance between the adjacent sorting trays in the take-out condition may be set to be larger than that in the receiving condition.

In the aforementioned embodiment, the distance between the sorting tray in the receiving position and the sorting tray, which is just above the sorting tray in the receiving position, in the receiving operation within the predetermined distance D is changed to be narrowed when the control unit 60 changes from the receiving operation to the take-out operation. This is because the sorting tray in the receiving position in the receiving operation is also used in the take-out operation. However, the present invention is not limited to such a construction, and the distance between a certain sorting tray without in the receiving position and the sorting tray which is just above the certain sorting tray in the receiving operation may be changed to be narrowed or widened in the take-out operation. Further, each distance between the adjacent sorting trays of all sorting trays in the receiving operation may be changed to be narrowed or widened when the control unit 60 changes from the receiving operation to the take-out operation.

In the aforementioned embodiment, the swing lever 68 of the sheet detecting mechanism 66 has the roller 72 at the distal end thereof. However, the present invention is not limited to such a construction, and the swing lever 68 has a guide rail 74 on the distal end thereof, as a first modification shown in FIG. 16.

Figure 16:
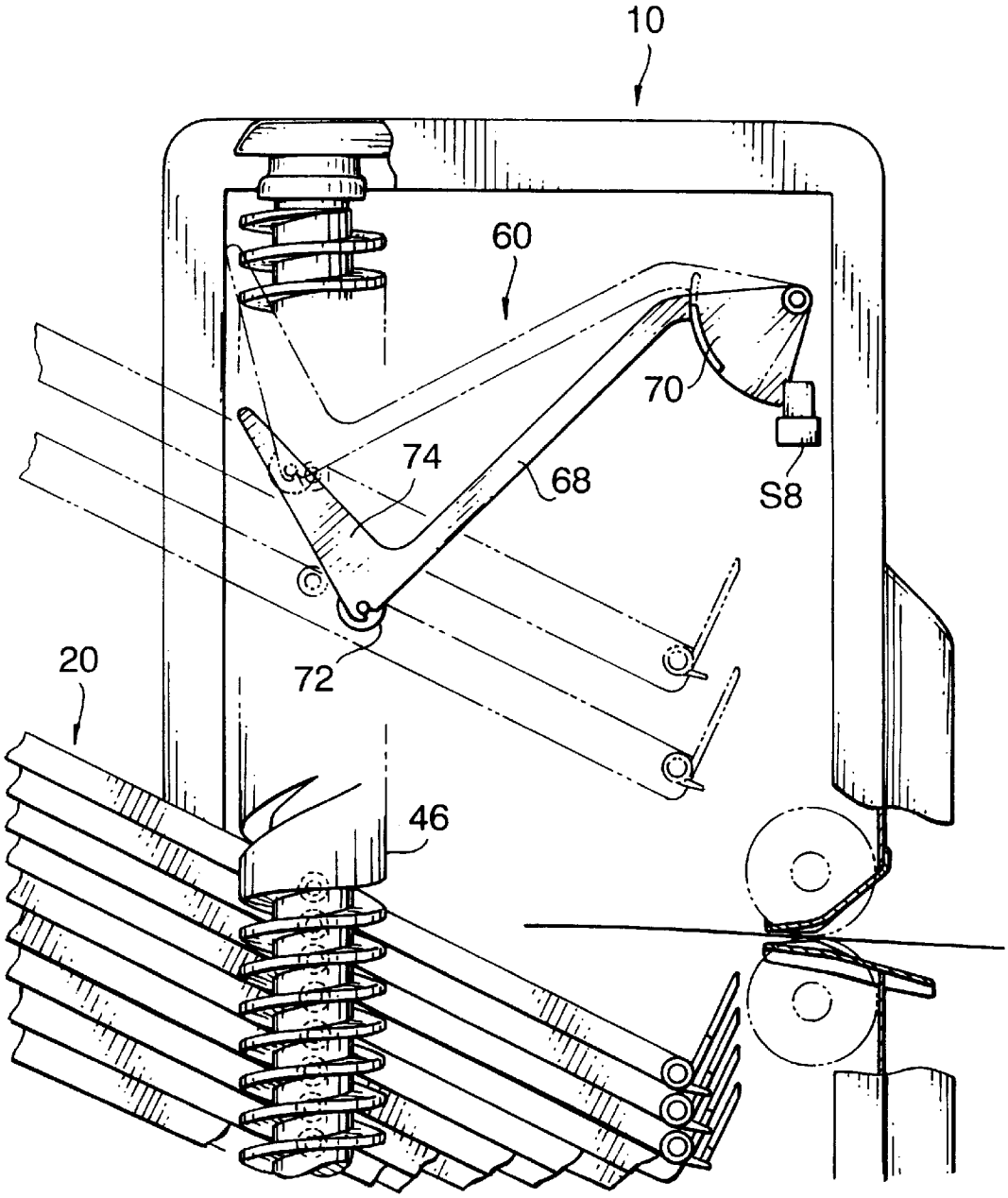
FIG. 16 is an enlarged front view showing a construction of a part of the sorter according to one modification of the present invention.

As shown in FIG. 16, the guide rail 74 is formed to extend rearward (that is, in the receiving direction X) and upward. Since the guide rail 74 is attached to the swing lever 68, it will be allowed to return the copied sheet, which has once been taken out from the sorting tray 20, to the original sorting tray 20, by being guided between the guide rail 74 and the copied sheet on the sorting tray 20 or between the guide rail 74 and the sorting tray 20.

In the aforementioned embodiment, the position of the sorting trays 20 is detected by using the sensors S5 and S6. However, the present invention is not limited to such a construction, and may constructed as a second modification shown in FIGS. 17 through 19, instead of sensors S5 and S6.

Figure 17:
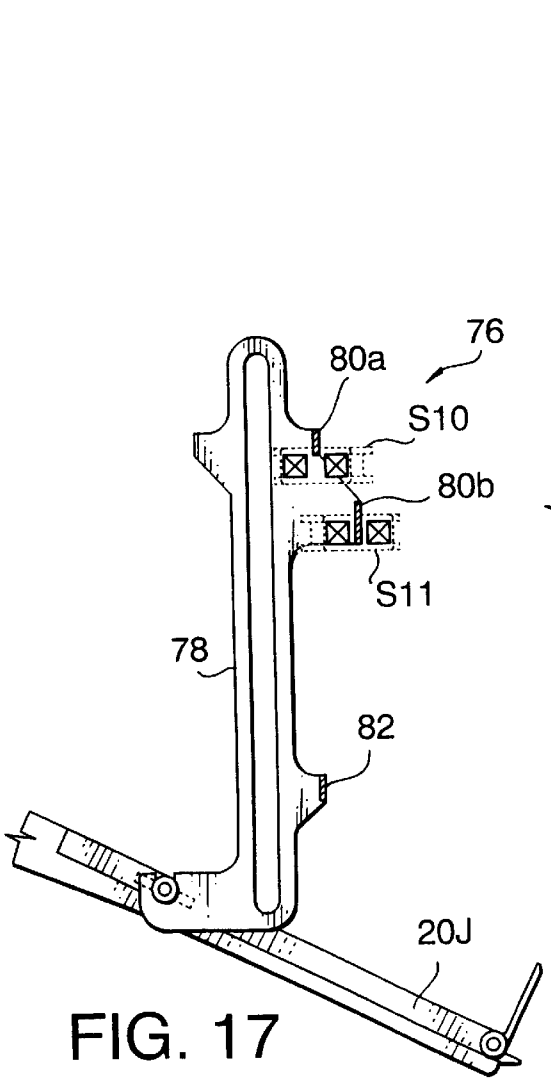
FIG. 17 is a front view showing a detecting mechanism for detecting a vertical position of the sorting tray in a condition where the home position of the sorting tray is detected.

As shown in FIG. 17, a tray position detecting mechanism 76 for detecting the position of the sorting trays 20 includes a detection lever 78 which is connected to a predetermined sorting tray 20, for example, the lowermost tenth sorting tray 20J, and a pair of sensors S10 and S11. Each of the sensors S10 and S11 is constructed by a so-called photo-interrupter including an LED and a photodiode.

The detection lever 78 includes an upper detected piece 80 which is integrally formed to the upper part thereof and a lower detected piece 82 which is integrally formed to the lower part thereof. The upper detected piece 80 is composed of an upper part 80*a* and a lower part 80*b* which are vertically separated to each other.

The sensor S10 is turned on when it is interrupted by the upper part 80*a* of the upper detected piece 80 and lower detected piece 82 and turned off when it is out of the upper or lower detected piece 80 or 82. The sensor S11 is turned on when it is interrupted by the lower part 80*b* of the upper detected piece 80 and turned off when it is out of the upper or lower detected piece 80 or 82.

Figure 19:
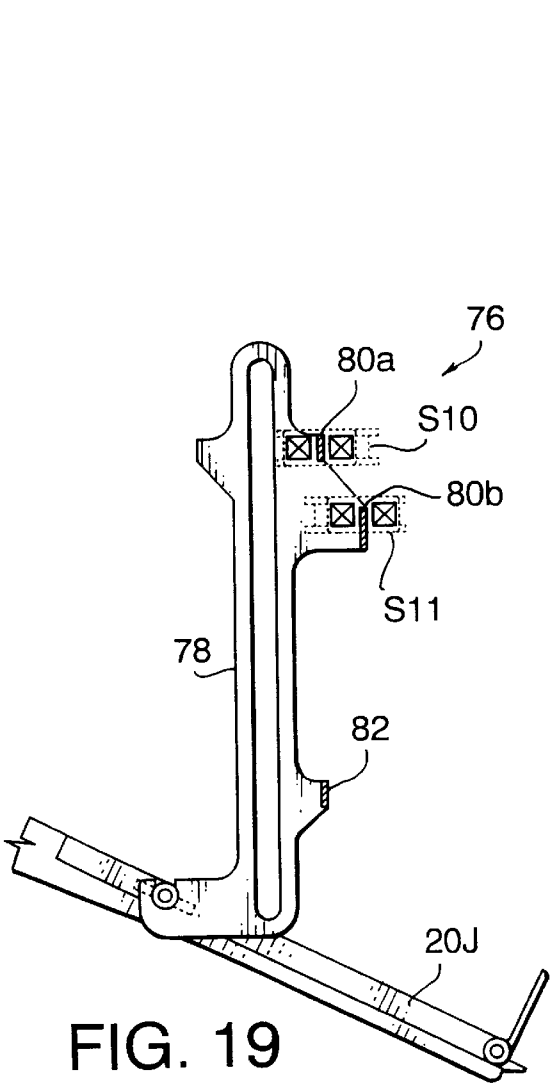
FIG. 19 is a front view showing the detecting mechanism in a condition where the lower limit position of the sorting tray is detected.
Figure 18:
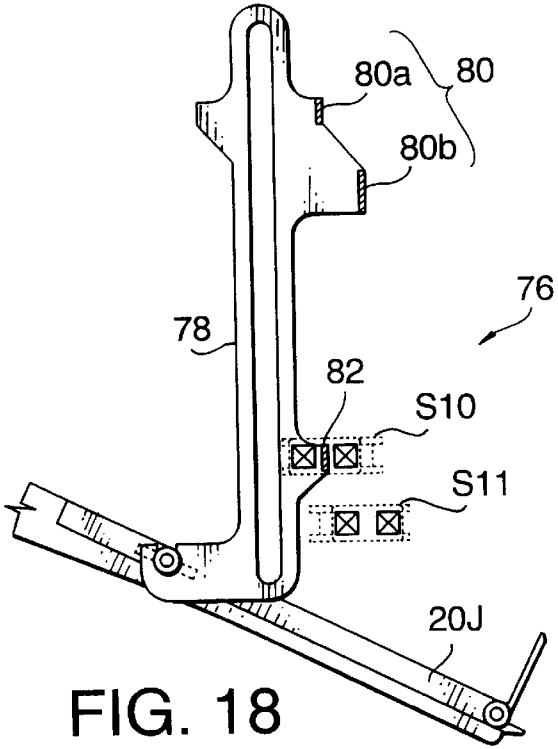
FIG. 18 is a front view showing the detecting mechanism in a condition where the upper limit position of the sorting tray is detected.

In the present modification, it is detected that the sorting trays 20 are in the home position when the sensors S10 and S11 are turned on as shown in FIG. 17, in the upper limit position when the sensor S10 is turned on and the sensor S11 is turned off as shown in FIG. 18, and in the lower limit position when the sensor S10 is turned of and the sensor S11 is turned on as shown in FIG. 19.

According to the present modification as shown in FIGS. 17 through 19, the same effects are accomplished as in the aforementioned embodiment in which the sensors S5 and S6 are used for detecting the position of the sorting trays 20.

As the present invention may be embodied in several forms without departing from the spirit of essential characteristics thereof, the present embodiment is therefore illustrative and not restrictive, since the scope of the present invention is defined by the appended claims rather than by the description preceding them, and all changes that fall within meets and bounds of the claims, or equivalence of such meets and bounds are therefore intended to embraced by the claims.

What is claimed is:

1. A sorter which comprises:

a plurality of sorting trays, to which at least one sheet onto which images have been copied is supplied from a sheet processor, and which are movable in a direction to go through, a sheet face that has images thereon:

drive means for moving the sorting trays in said direction to go through a sheet face that has images thereon;

mode changing means for changing a sheet receiving mode where the sheets are supplied from the sheet processor and received on said sorting trays to a sheet take-out mode where the sheets received on said sorting trays are taken out after completion of a sheet receiving operation for all sorting trays due to receive sheets during said sheet receiving mode; and control means for controlling said drive means to change an interval pattern of adjacent sorting trays in the direction to go through a sheet face that has images at the sheet receiving mode and at the sheet take-out mode.

2. The sorter according to claim 1, wherein the interval pattern at the sheet receiving mode has an interval between a sorting tray in a sheet receiving position onto which the sheets are received and a sorting tray which is positioned just above the sorting tray in the sheet receiving position different from an interval at the sheet take out mode.

3. The sorter according to claim 2, wherein the interval pattern at the sheet receiving mode has the interval between a sorting tray in a sheet receiving position onto which the sheets are received and a sorting tray which is positioned just above the sorting tray in the sheet receiving position wider than the interval at the sheet take-out mode.

4. The sorter according to claim 3, wherein the interval pattern at the sheet receiving mode has the widest interval between a sorting tray in a sheet receiving position onto which the sheets are received and a sorting tray which is positioned just above the sorting tray in the sheet receiving position;

and wherein the interval pattern in the sheet take-out mode includes at least two of a widest interval, said widest interval in the sheet receiving mode being wider than said widest interval in the sheet take-out mode.

5. The sorter according to claim 2, wherein a total number of adjacent sorting trays in said sheet receiving mode having a wider interval is different from a total number of adjacent sorting trays in said sheet take-out having a wider interval.

6. The sorter according to claim 5, wherein the total number of adjacent sorting trays in said sheet receiving mode having a wider interval is less than the total number of adjacent sorting trays in said sheet take-out mode having a wider interval.

* * * * *